US009274494B2

(12) United States Patent
Shiraki

(10) Patent No.: US 9,274,494 B2
(45) Date of Patent: Mar. 1, 2016

(54) IMAGE FORMING APPARATUS

(71) Applicant: Brother Kogyo Kabushiki Kaisha, Nagoya-shi, Aichi-ken (JP)

(72) Inventor: Masatoshi Shiraki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/522,807

(22) Filed: Oct. 24, 2014

(65) Prior Publication Data

US 2015/0117874 A1 Apr. 30, 2015

(30) Foreign Application Priority Data

Oct. 25, 2013 (JP) ..... 2013-221800

(51) Int. Cl.
*G03G 21/18* (2006.01)
*G03G 21/16* (2006.01)

(52) U.S. Cl.
CPC ..... *G03G 21/1676* (2013.01); *G03G 21/1896* (2013.01)

(58) Field of Classification Search
CPC ..... G03G 21/1825; G03G 21/1896; G03G 2221/1892; G03G 21/1676
USPC ..... 399/13, 111
See application file for complete search history.

(56) References Cited

U.S. PATENT DOCUMENTS

| | | | | |
|---|---|---|---|---|
| 7,509,071 | B2 | 3/2009 | Yoshimura et al. | |
| 2006/0177230 | A1* | 8/2006 | Ishii | 399/12 |
| 2007/0147852 | A1* | 6/2007 | Aratachi | G03G 21/1896 399/12 |
| 2007/0160388 | A1 | 7/2007 | Yoshimura et al. | |
| 2012/0237252 | A1 | 9/2012 | Yoshimura et al. | |
| 2013/0315622 | A1 | 11/2013 | Yoshimura et al. | |

FOREIGN PATENT DOCUMENTS

JP 2007-213025 A 8/2007

* cited by examiner

*Primary Examiner* — David Gray
*Assistant Examiner* — Thomas Giampaolo, II
(74) *Attorney, Agent, or Firm* — Banner & Witcoff, Ltd.

(57) ABSTRACT

An image forming apparatus, including a main body and a cartridge configured to be detachably attached to the main body, is provided. The cartridge includes a photosensitive member configured to carry an image formed in a developer agent thereon, a movable mechanism, and a developer roller configured to supply the developer agent to the photosensitive member. The movable mechanism is configured to shift between a first state, in which the developer roller is placed in a contact position to contact the photosensitive member, and a second state, in which the developer roller is placed in a separated position to be separated from the photosensitive member. The main body includes a detectable member configured to detect a state of the movable mechanism between the first state and the second state.

9 Claims, 18 Drawing Sheets

91

IMAGE FORMING APPARATUS

CROSS REFERENCE TO RELATED APPLICATION

This application claims priority from Japanese Patent Application No. 2013-221800, filed on Oct. 25, 2013, the entire subject matter of which is incorporated herein by reference.

BACKGROUND

1. Technical Field

An aspect of the present invention relates to an image forming apparatus capable of forming an image in an electro-photographic method.

2. Related Art

An image forming apparatus configured to form an image in an electro-photographic method is known. The conventionally known image forming apparatus may be equipped with a removable processing cartridge, which is capable of storing a toner therein. The processing cartridge may be configured to have a drum unit and a developer unit integrally. The drum unit may contain a photosensitive drum, and a developer unit may contain a developer roller integrally, while the developer roller in the developer unit may be movable to be in contact with or separated from the photosensitive drum in the drum unit.

SUMMARY

The above-mentioned electro-photographic image forming apparatus, however, may not be equipped with a mechanism to detect a condition of the developer roller: as to whether the developer roller is in contact with or separated from the photosensitive drum.

Therefore, there is a risk that an action, which should be performed when the developer roller is separated from the photosensitive drum, may be performed when the developer roller is actually in contact with the photosensitive drum, or vice versa.

The present invention is advantageous in that an image forming apparatus capable of detect the condition of the developer roller, which is one of being in contact with and separated from a photosensitive member, is provided.

According to an aspect of the present invention, an image forming apparatus, including a main body and a cartridge configured to be detachably attached to the main body, is provided. The cartridge includes a photosensitive member configured to carry an image formed in a developer agent thereon, a movable mechanism, and a developer roller configured to supply the developer agent to the photosensitive member. The movable mechanism is configured to shift between a first state, in which the developer roller is placed in a contact position to contact the photosensitive member, and a second state, in which the developer roller is placed in a separated position to be separated from the photosensitive member. The main body includes a detectable member configured to detect a state of the movable mechanism between the first state and the second state.

BRIEF DESCRIPTION OF THE ACCOMPANYING DRAWINGS

Figure 3A:
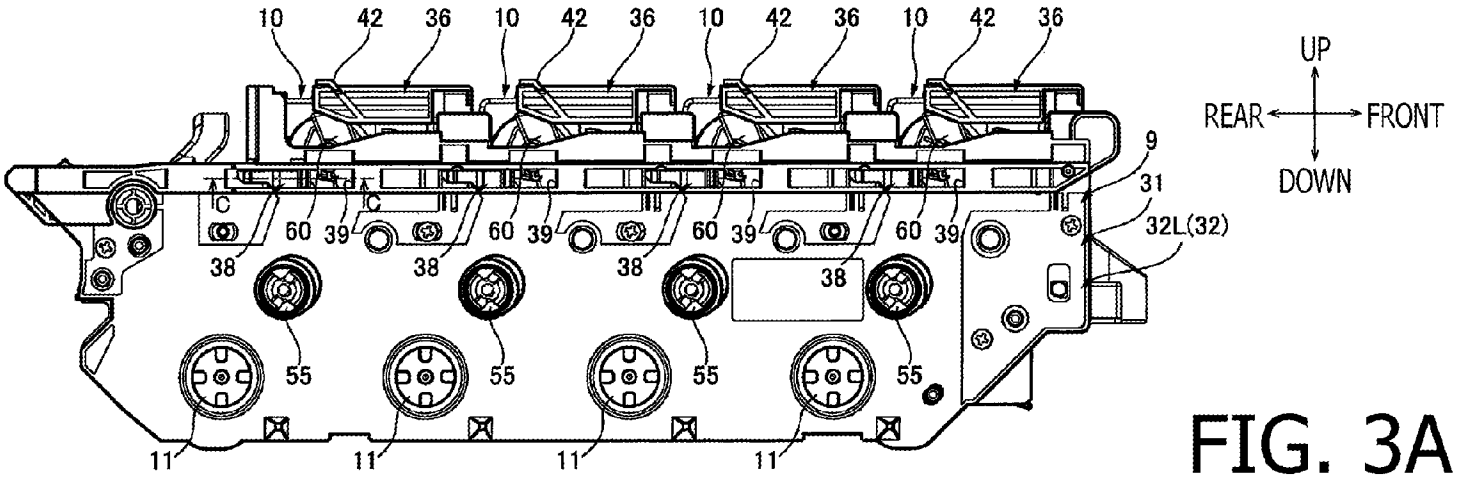
FIG. 3A is a left-side view of the processing unit in the printer according to the first embodiment of the present invention.
Figure 5A:
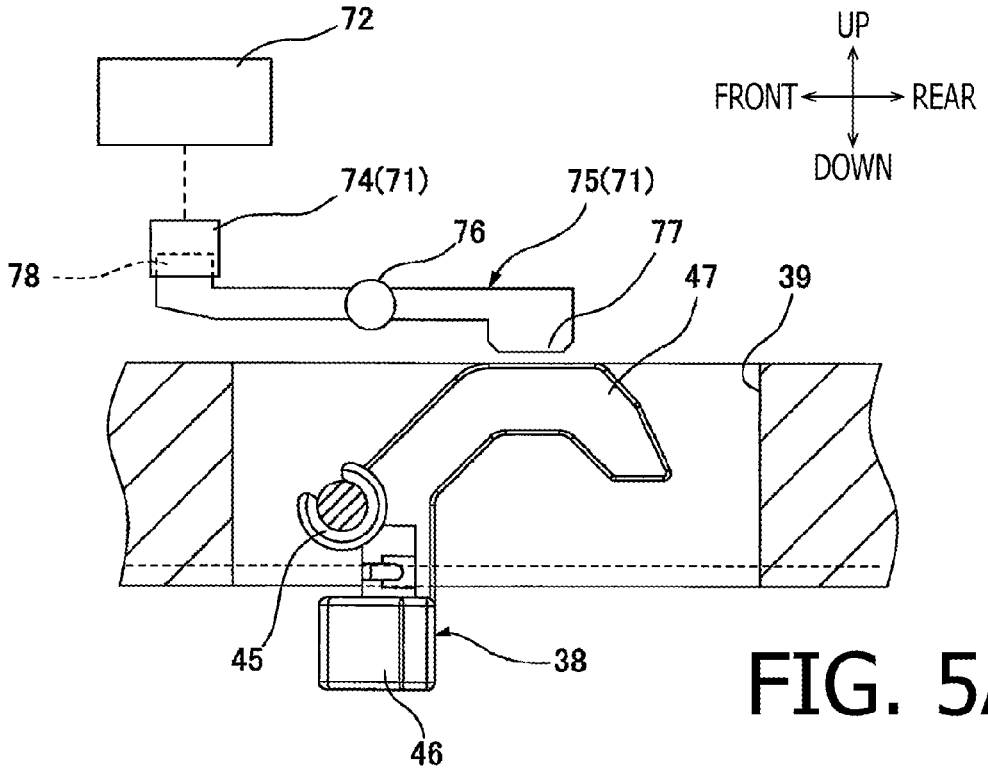
Figure 5B:
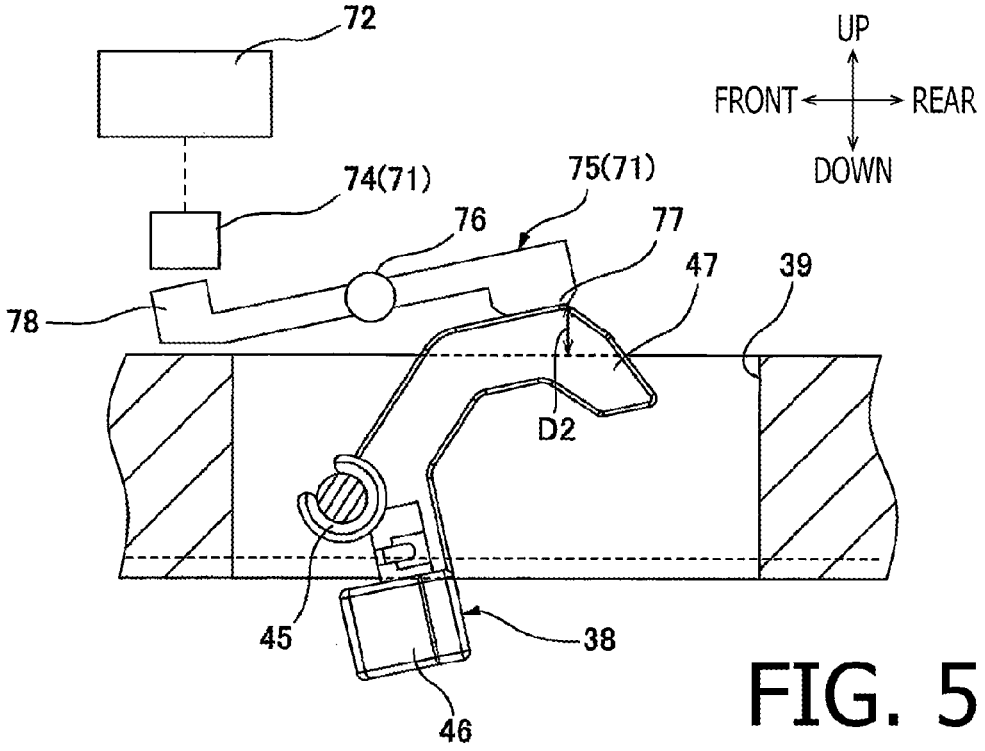

FIG. 5A is a cross-sectional view of the processing unit in the printer according to the first embodiment of the present invention taken along a line C-C shown in FIG. 3A, in which an on-processing unit actuator is in an undetectable position, whereas an on-body actuator is in a blocking position. FIG. 5B is a cross-sectional view of the processing unit in the printer according to the first embodiment of the present invention taken along the line C-C shown in FIG. 3A, in which the actuator in the processing unit is in a detectable position, whereas the actuator in the printer body is in a non-blocking position.

Figure 6:
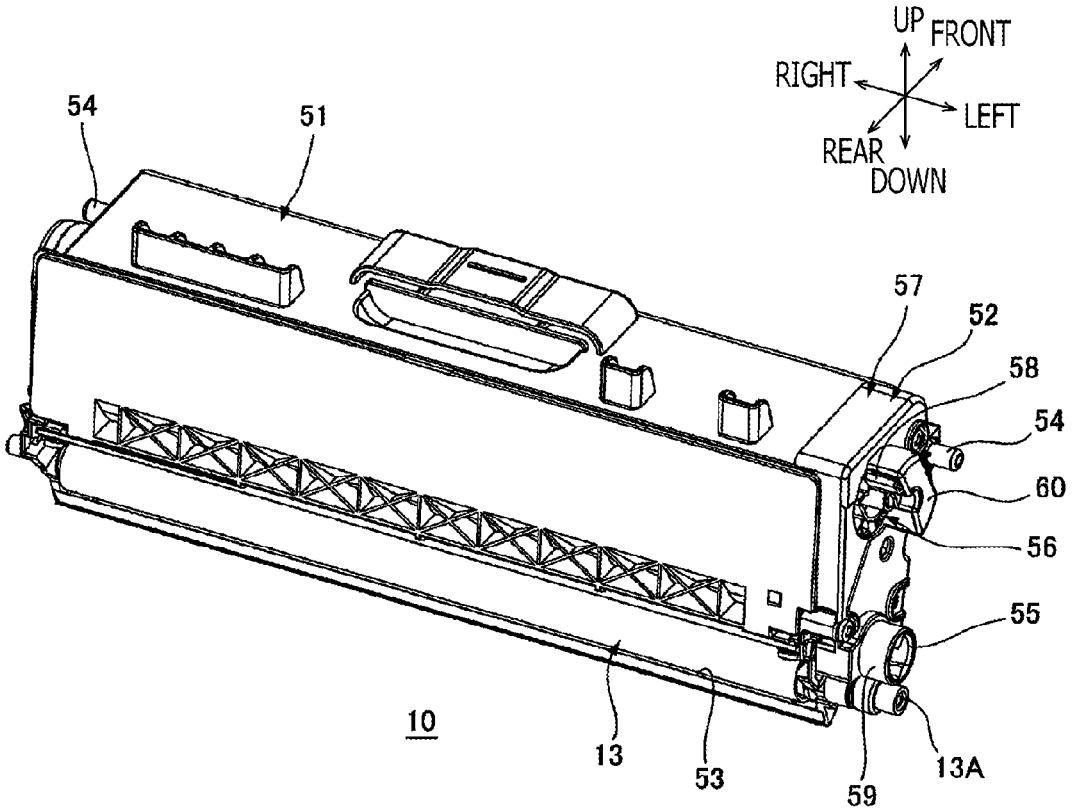

FIG. 6 is a perspective view of a developer cartridge in the printer according to the first embodiment of the present invention viewed at an upper-left angle.

Figure 7:
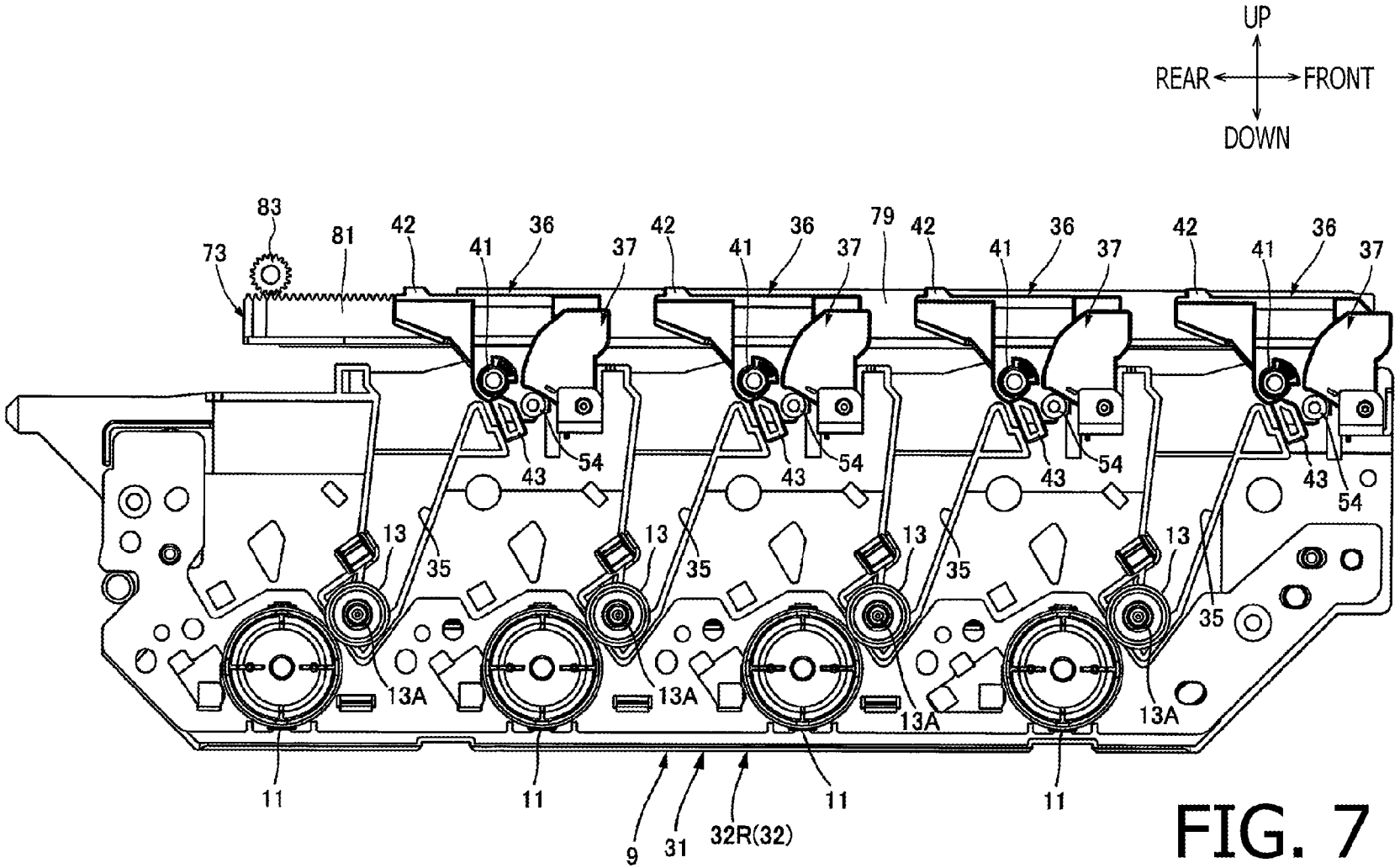

FIG. 7 is a side view of the processing unit according to the first embodiment of the present invention illustrating the printer being in a color mode.

Figure 8:
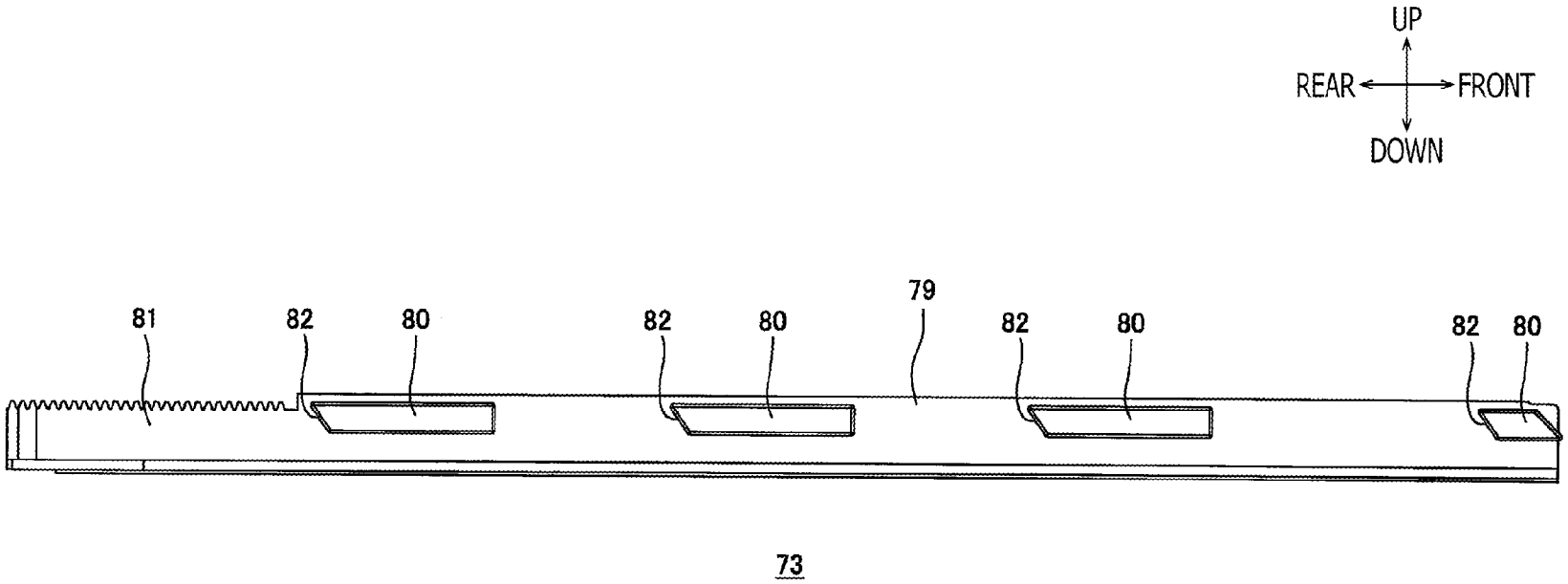

FIG. 8 is a left-side view of a linear motion cam in the printer according to the first embodiment of the present invention.

Figure 9:
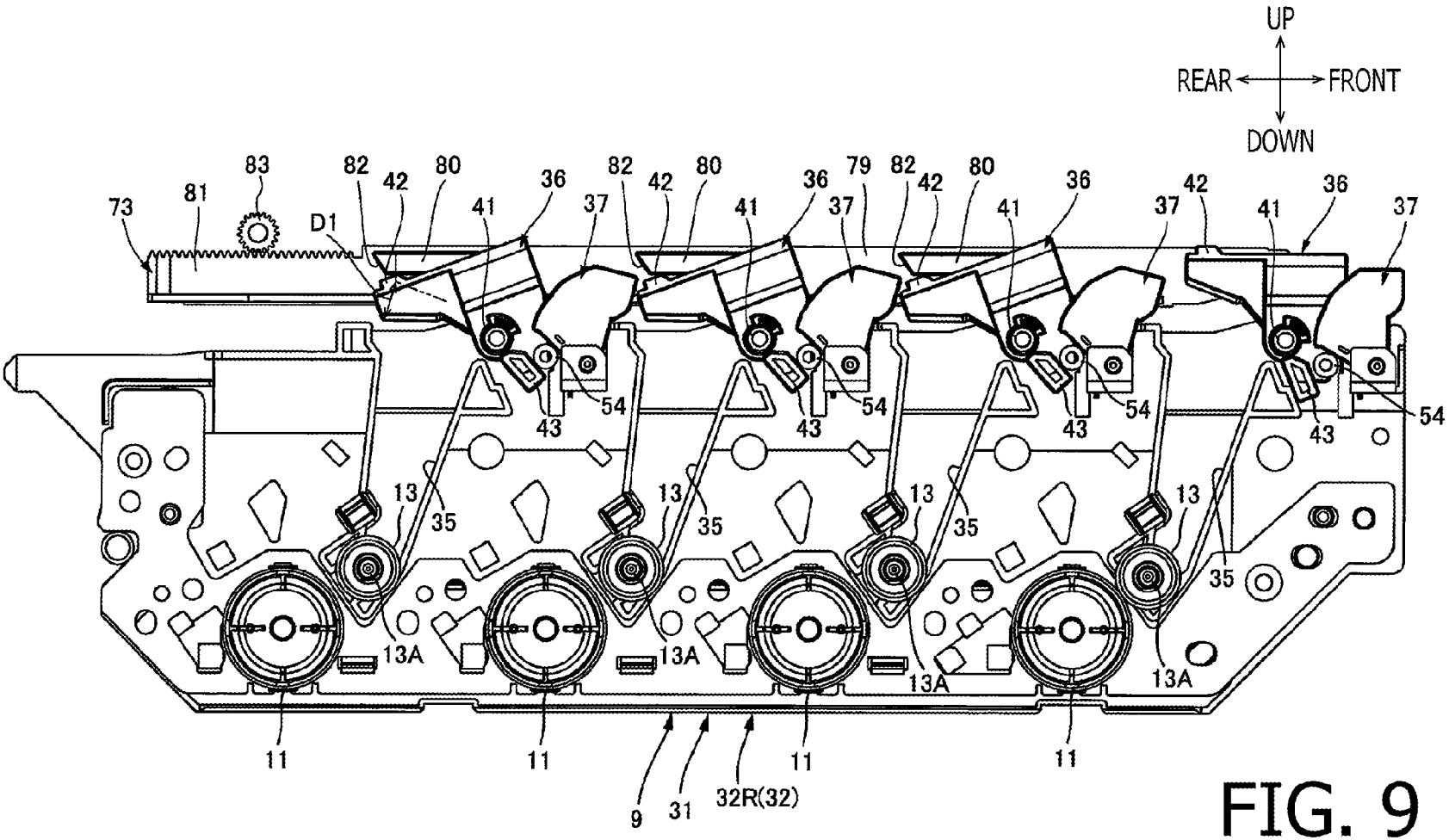

FIG. 9 is a side view of the processing unit according to the first embodiment of the present invention illustrating the printer being in a monochrome mode.

Figure 10:
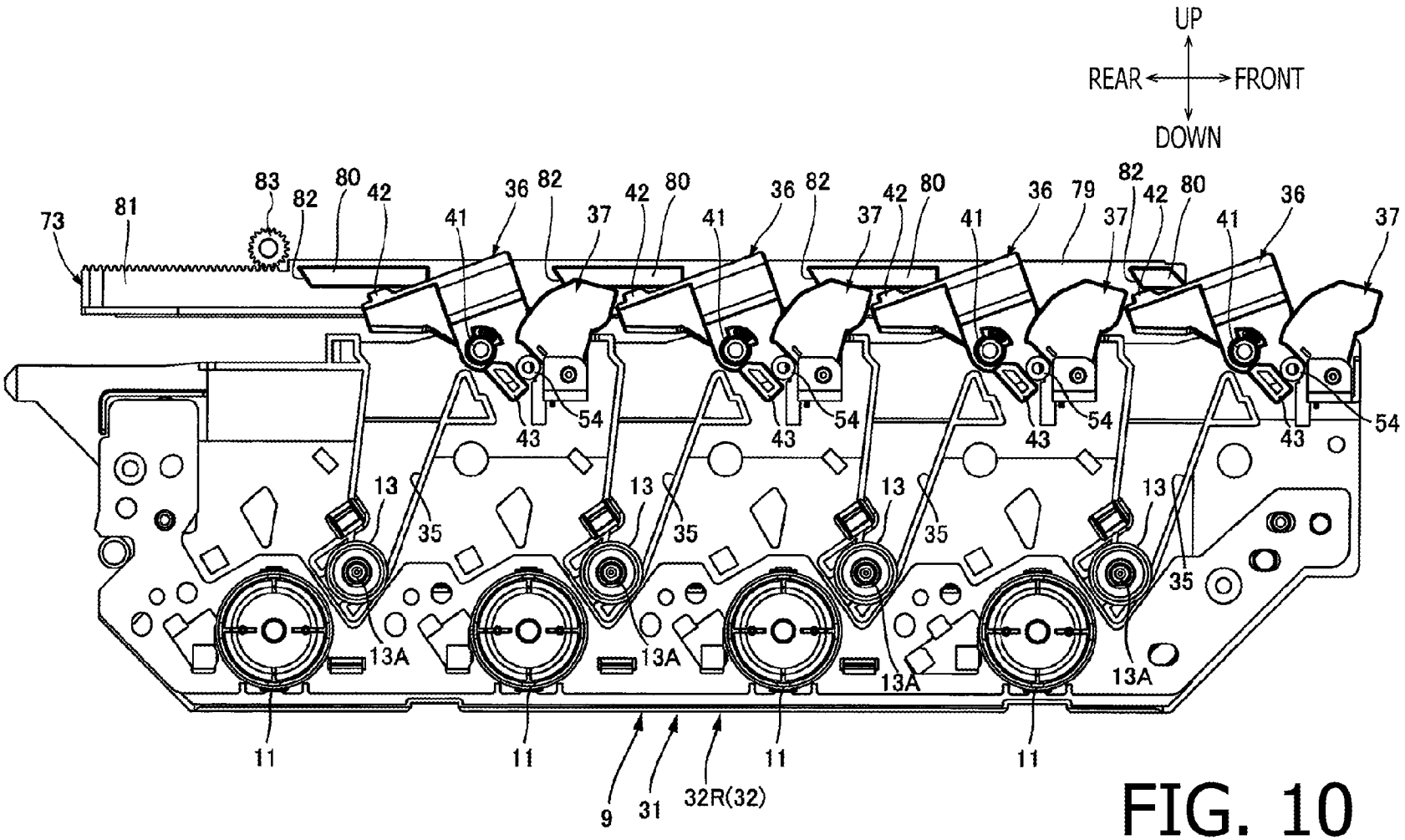

FIG. 10 is a side view of the processing unit according to the first embodiment of the present invention illustrating the printer being in an all-separated mode.

Figure 11:
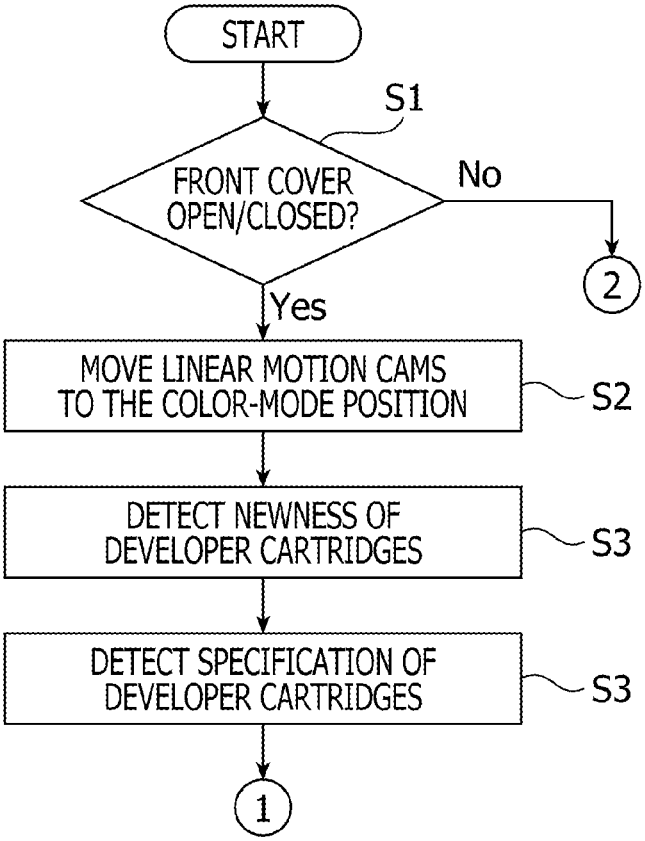
Figure 12:
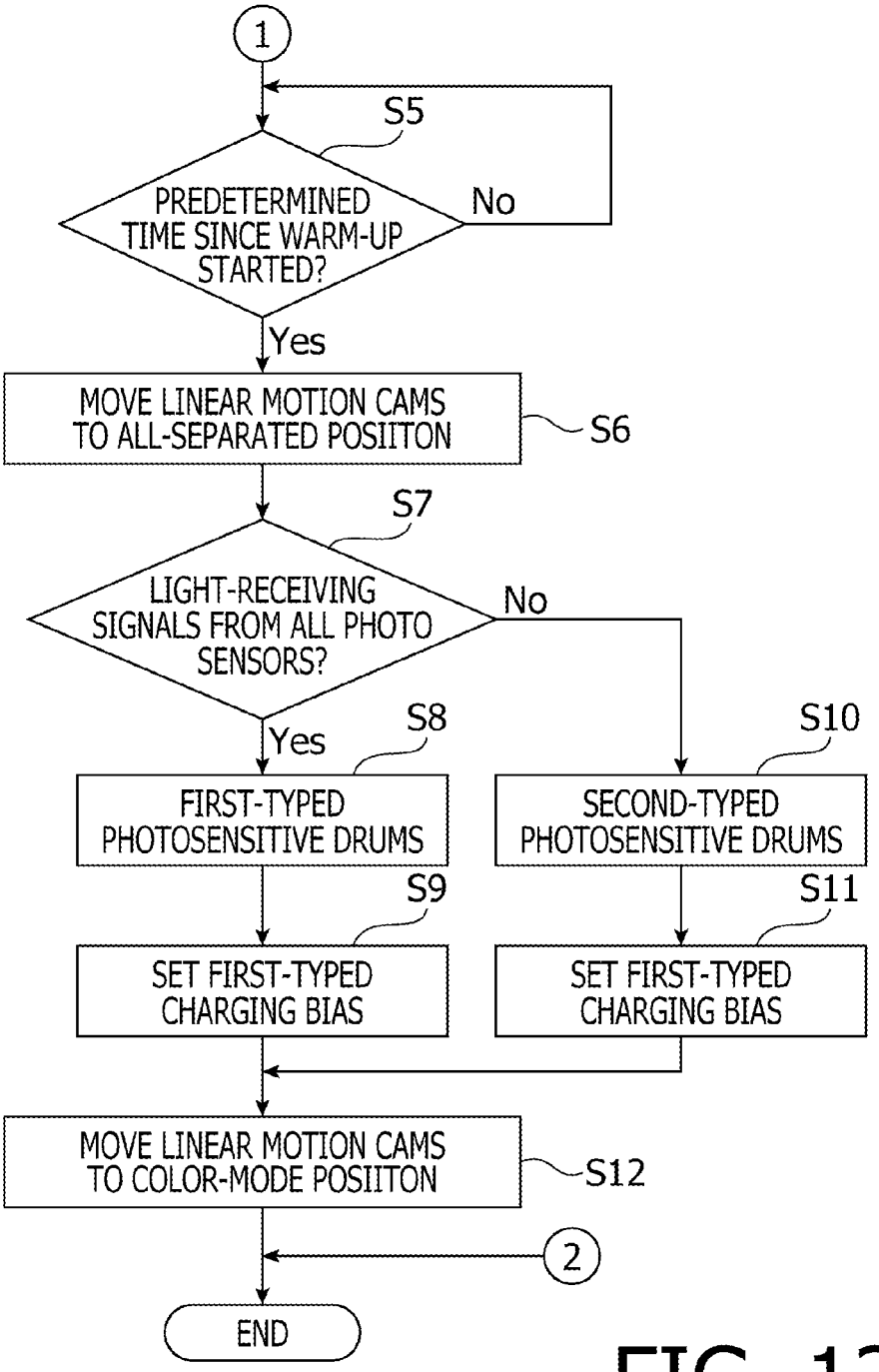

FIG. 11 is a flowchart to illustrate a warming-up activity of the printer, including a step to detect newness of the developer cartridge and a step to detect specification of the developer cartridge, according to the first embodiment of the present invention FIG. 12 is a flowchart to illustrate the warming-up activity of the printer, continuous from the flowchart in FIG. 11, including a step to detect specification of a drum unit, according to the first embodiment of the present invention.

Figure 13:
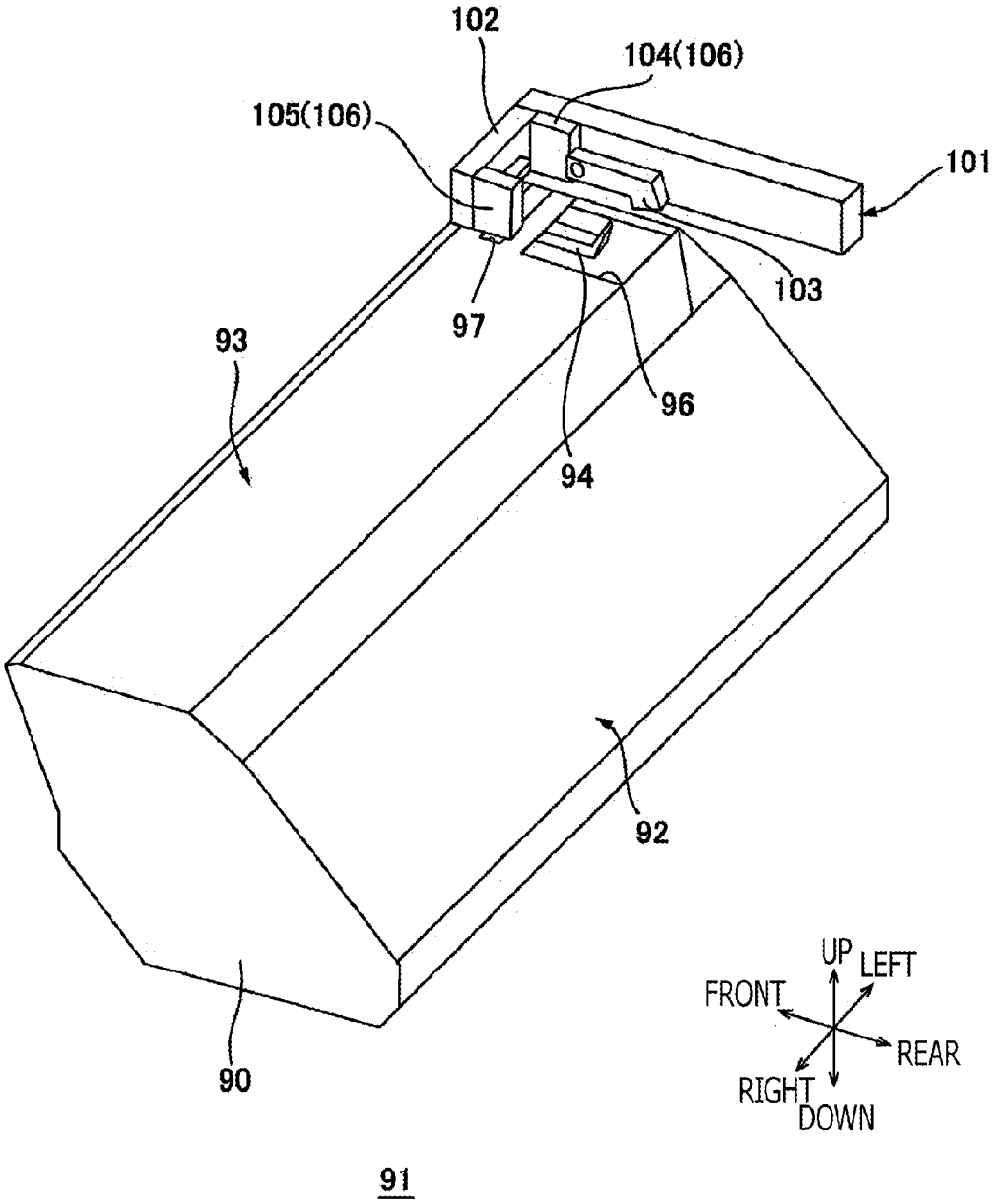

FIG. 13 is a perspective view of a processing cartridge to be attached to a printer according to a second embodiment of the present invention viewed at an upper-right angle.

Figure 14:
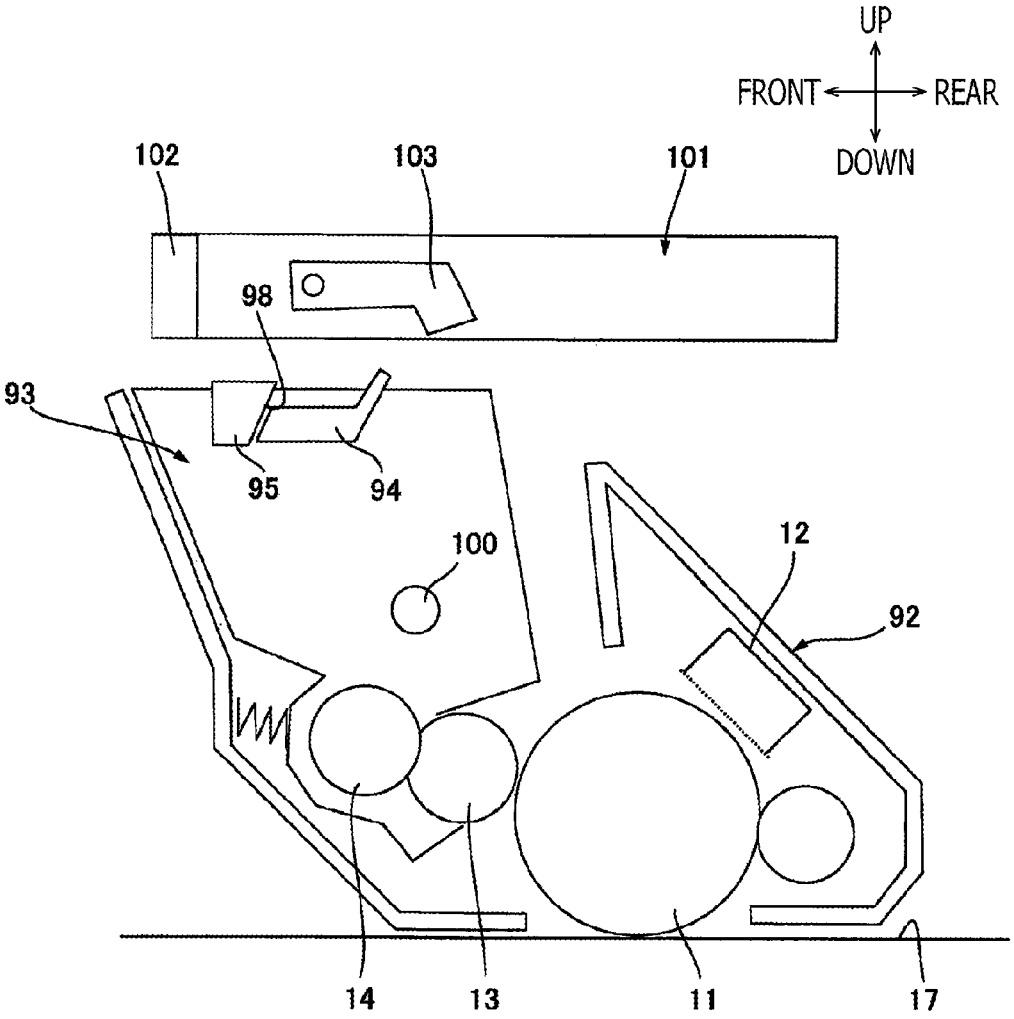

FIG. 14 is a cross-sectional view at a crosswise center of the printer according to the second embodiment of the present invention.

Figure 15:
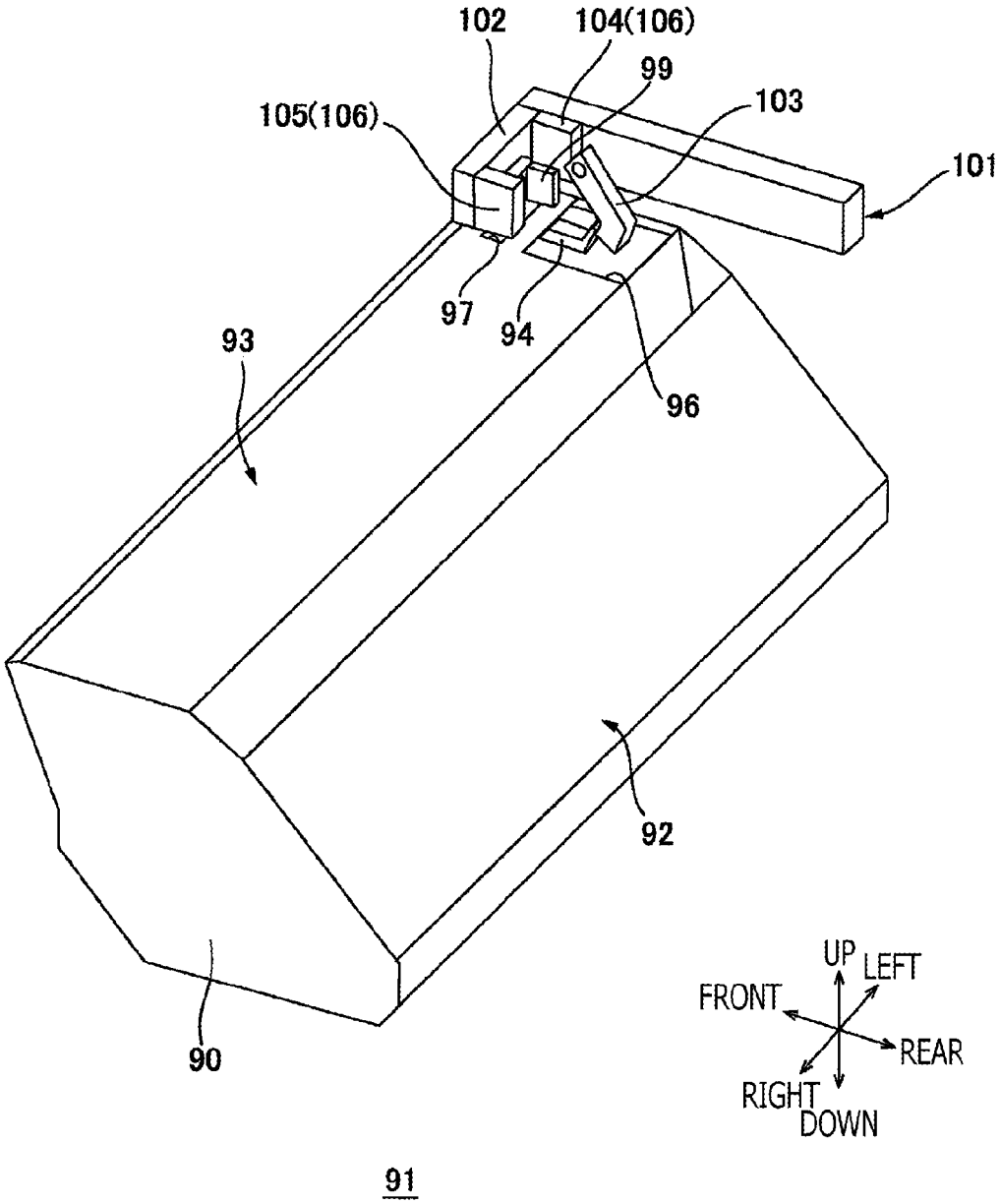

FIG. 15 is a perspective view of the processing cartridge of the printer according to the second embodiment of the present invention with a developer roller being in a transitive motion to be in contact with or separated from a photosensitive drum wherein the linear motion cam is in a first position and a pivotable member is in an engageable position.

Figure 16:
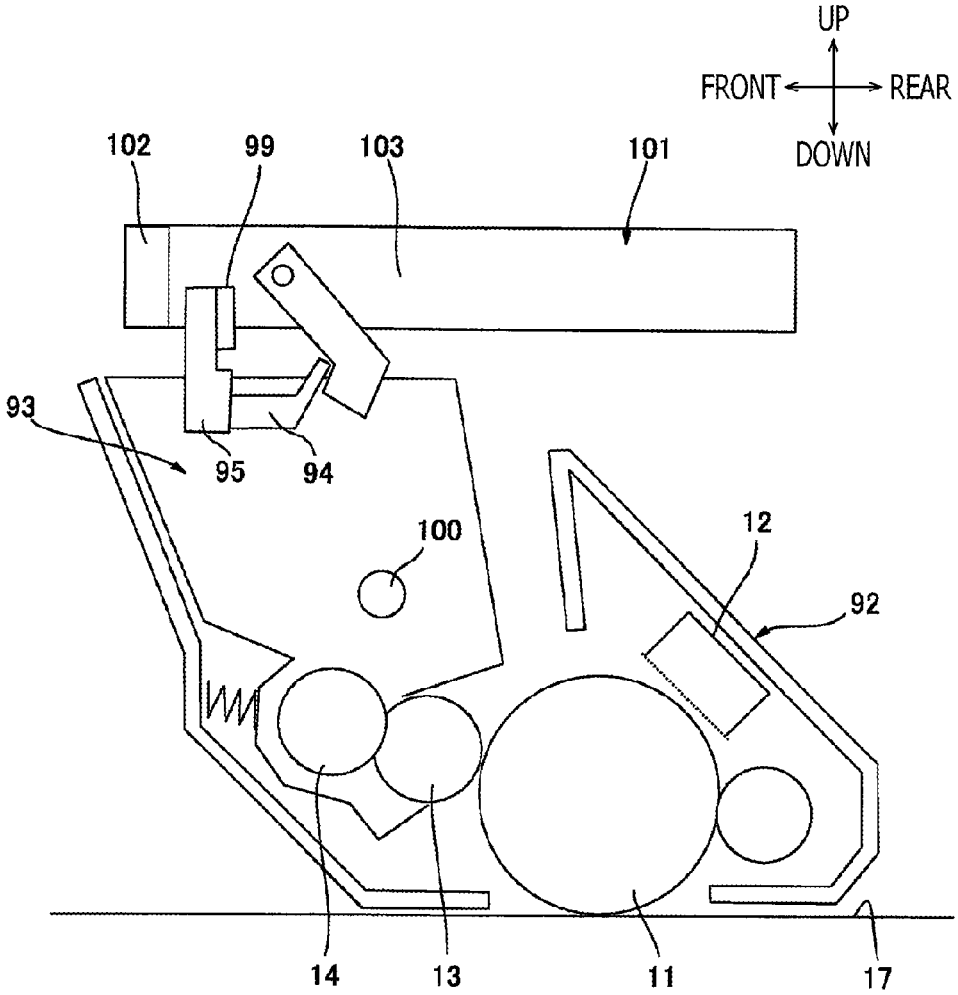

FIG. 16 is a cross-sectional view at the crosswise center of the printer according to the second embodiment of the present invention when the processing cartridge is in a state shown in FIG. 15.

Figure 17:
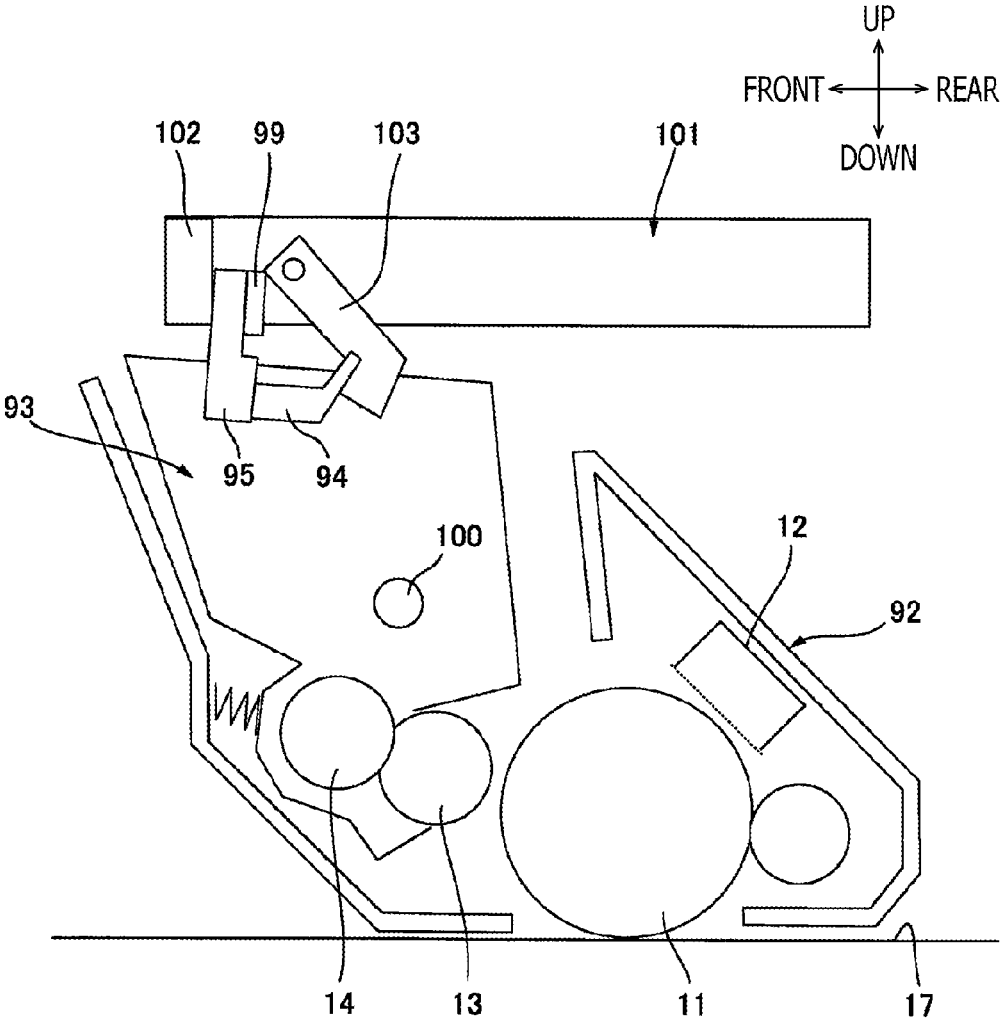

FIG. 17 is a perspective view of the processing cartridge of the printer according to the second embodiment of the present invention with the developer roller being in the motion to be in contact with separated from the photosensitive drum, continuously from the state shown in FIG. 15, wherein the rotating member is in the engageable position and the linear motion cam is in a second position.

Figure 18:
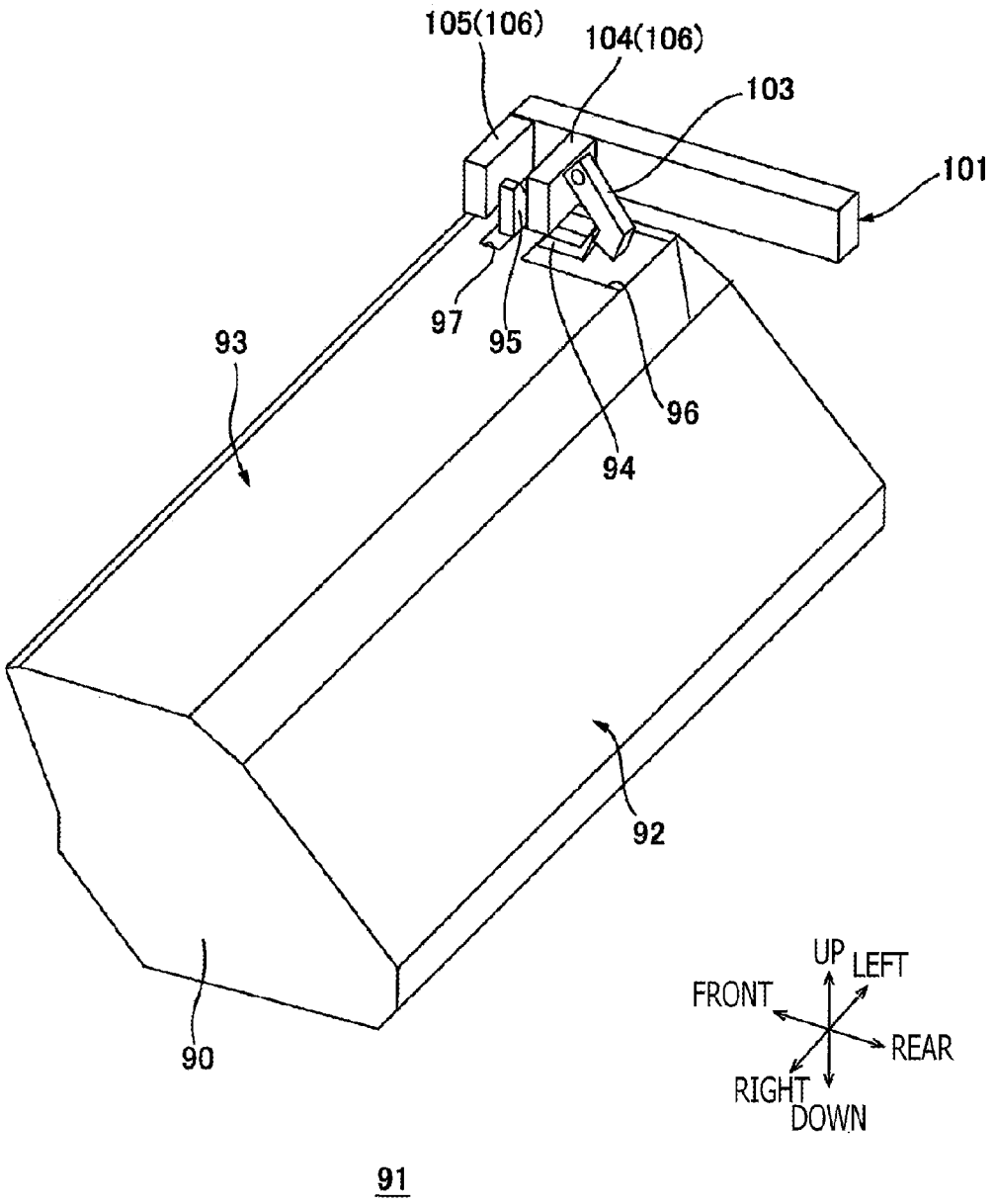

FIG. 18 is a modified example of the processing cartridge to be attached to the printer according to the second embodiment of the present invention.

DETAILED DESCRIPTION

Hereinafter, a configuration of a printer 1 according to embodiments of the present invention will be described with reference to the accompanying drawings.

1. Overall Configuration of the Printer

Figure 1:
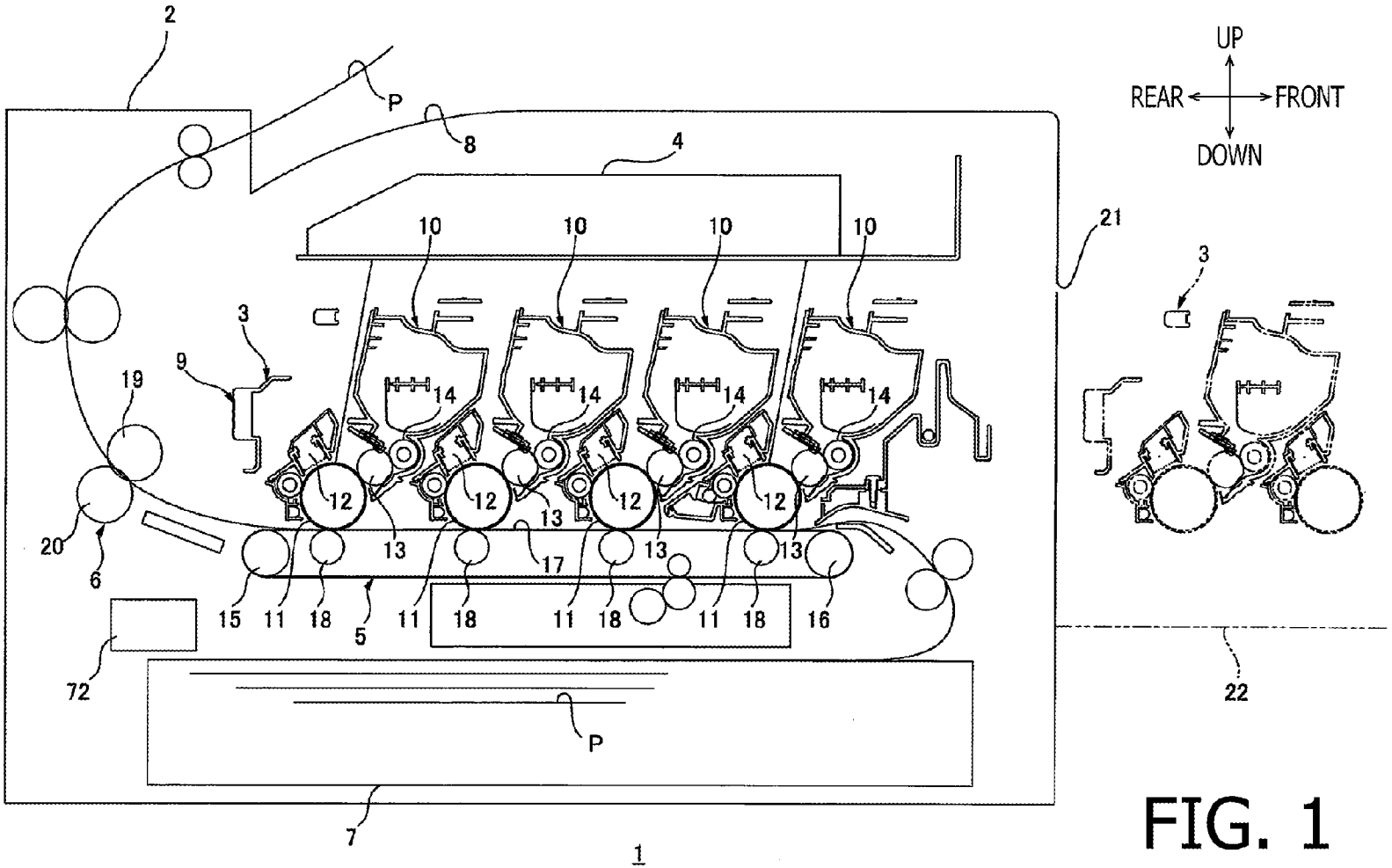
FIG. 1 is a cross-sectional view at a crosswise center of a printer according to a first embodiment of the present invention.

First, an overall configuration of the printer 1 will be described. The printer 1 is a direct tandem-typed color printer, which can be placed in a horizontally laid-flat orientation, as shown in FIG. 1.

In the following description, directions concerning the printer 1 will be mentioned in accordance with orientation indicated by arrows in each drawing. A vertical direction of the printer 1 is defined with reference to an up-to-down or down-to-up direction for the printer 1 in an ordinarily usable posture (see FIG. 1). Further, other directions concerning the printer 1 will be mentioned based on the ordinarily usable posture of the printer 1. In other words, the up-to-down or down-to-up direction in FIG. 1 coincides with the vertical direction, and a viewer's right-hand side in FIG. 1 is defined as a front side of the printer 1, whereas a viewer's left-hand side in FIG. 1 is defined as a rear side of the printer 1. A front-to-rear or rear-to-front direction is defined as a direction of depth and may be referred to as a front-rear direction. A viewer's nearer side in FIG. 1, which comes on a left-hand side for a user of the printer 1 when the user faces the front side, is mentioned as a left side or a left-hand side. A side opposite from the left, which is on the viewer's farther side, is mentioned as a right side or a right-hand side. A right-to-left or left-to-right direction of the printer 1 may also be referred to as a right-left direction or a crosswise direction. The directions shown in FIGS. 1-10, and 13-18 correspond to those indicated by the arrows appearing in FIG. 1.

The printer 1 includes a main casing 2, a processing unit 3, a scanner unit 4, a transfer unit 5, and a fixing unit 6.

The main casing 2 is formed to have an approximate shape of a box and includes an opening 21, a front cover 22, a feeder tray 7, and an ejection tray 8.

The opening 21 is formed on a front face of the main casing 2. The opening 21 penetrates the main casing 2 along the front-rear direction to communicate internal space in the main casing 2 with outer atmosphere and provides a passage for the processing unit 3 to pass through the front face of the main casing 2.

The front cover is arranged on the front side of the main casing 2. The front cover is formed to have an approximate shape of a flat plate. The front cover 22 spreads along the vertical direction and is supported at a lower end thereof by the front face of the main casing 2. The front cover 22 is pivotable between an open position, indicated by a dash-and-double-dot line in FIG. 1, in which the opening 21 is exposed, and a closed position, indicated by a solid line in FIG. 1, in which the opening 21 is covered.

The feeder tray 7 is arranged in a lower position in the main casing 2. The feeder tray 7 is configured to accommodate sheets P therein.

The ejection tray 8 is arranged on an upper part of the main casing 2 to form a part of an upper face of the main casing 2. The ejection tray 8 is formed to recess downward so that the ejected sheets P can be placed thereon.

The processing unit 3 is arranged in an approximately central position in the main casing 2. The processing unit 3 is movable with respect to the main casing 2, when the front cover 22 is in the open position, between an outer position, which is outside the main casing 2, for example as indicated by dash-and-double-dot lines in FIG. 1, and, an inner position, which is inside the main casing 2 as indicated by solid lines in FIG. 1. The processing unit 3 is detachably attachable to the main casing 2. The processing unit 3 includes a drum unit 9 and a plurality of developer cartridges 10.

The drum unit 9 includes a plurality of photosensitive drums 11 and a plurality of scorotron chargers 12.

Each of the photosensitive drums 11 is rotatably supported at a lower end of the processing unit 3 and corresponds to one of four (4) colors: black, yellow, magenta, and cyan. The photosensitive drums 11 are arranged in parallel with one another and to be spaced apart from one another along the front-rear direction. In particular, in a direction from front toward rear, a photosensitive drum 11K corresponding to the color of black, the photosensitive drum 11Y corresponding to the color of yellow, the photosensitive drum 11M corresponding to the color of magenta, and the photosensitive drum 11C corresponding to color of cyan are arranged in the order mentioned above. Each of the photosensitive drums 11 is formed to have a cylindrical shape elongated along the crosswise direction.

Each of the plurality of scorotron chargers 12 corresponds to one of the photosensitive drums 11 and is arranged in an upper-rearward position with respect to the corresponding one of the photosensitive drums 11 with some amount of clearance reserved from the corresponding one of the photosensitive drums 11.

Each of the plurality of developer cartridges 10 corresponds to one of the photosensitive drums 11 and is arranged in an upper position with respect to the corresponding one of the photosensitive drums 11. Each of the developer cartridges 10 includes a developer roller 13 and a supplier roller 14. Each developer cartridge 10 accommodates a developer agent, such as a toner, in one of the four colors in a room formed therein in an upper position with respect to the developer roller 13 and the supplier roller 14.

The developer roller 13 is rotatably supported at a lower end of the developer cartridge 10 and is arranged to be partly exposed rearward from the developer cartridge 10. The developer roller 13 is arranged to rotatably contact an upper-front part of the one of the photosensitive drums 11.

The supplier roller 14 is arranged in an upper-front position with respect to the developer roller 13. The supplier roller 14 is arranged to rotatably contact an upper-front part of the developer roller 13.

The scanner unit 4 is arranged in an upper position with respect to the processing unit 3. The scanner unit 4 emits laser beams toward the photosensitive drums 11, as illustrated by solid lines in FIG. 1, according to inputted image data so that the photosensitive drums 11 are exposed to the emitted laser beams.

The transfer unit 5 is arranged in a lower position with respect to the processing unit 3. The transfer unit 5 includes a driving roller 15, a driven roller 16, a conveyer belt 17, and a plurality of transfer rollers 18.

The driving roller 15 is arranged at a rear end of the transfer unit 5.

The driven roller 16 is arranged at a front end of the transfer unit 5, in a frontward spaced-apart position with respect to the driving roller 15, to oppose the driving roller 15.

The conveyer belt 17 is rolled around the driving roller 15 and the driven roller 16 and is arranged to contact each of the photosensitive drums 11 at an upper part thereof. The conveyer belt 17 is moved to circulate according to rotation of the driving roller 15 and a driven rotation of the driven roller 16 in a direction such that the upper part thereof is moved rearward.

Each of the plurality of transfer rollers 18 corresponds to one of the photosensitive drums 11 and is arranged in a lower position with respect to the corresponding one of the photosensitive drums 11 across the upper part of the conveyer belt 17.

The fixing unit 6 is arranged in a rearward position with respect to the transfer unit 5. The fixing unit 6 includes a heat roller 19 and a pressure roller 20. The pressure roller 20 is arranged to rotatably contact the heat roller 19.

When the printer 1 starts an image forming operation, the scorotron chargers 12 charge surfaces of the photosensitive drums 11 evenly. Thereafter, the scanner unit 4 exposes the surfaces of the photosensitive drums 11 to the laser beams. Thereby, latent images based on the inputted image data are formed on the surfaces of the photosensitive drums 11.

Meanwhile, each of the supplier rollers 14 supplies the toner in the developer cartridge 10 to the developer roller 13. In this regard, the toner is frictionally charged positively between the developer roller 13 and the supplier roller 14 and carried on the developer roller 13.

The developer roller 13 supplies the carrying toner to the latent image formed on the surface of the photosensitive drum 11. Thereby, a toner image is formed on the surface of the photosensitive drum 11.

Meanwhile, the sheets P are conveyed from the feeder tray 7 upper-frontward according to rotation of the rollers and turned around upper-rearward to be fed at a predetermined timing one-by-one to a position between the photosensitive drum 11Y corresponding to the color of yellow and the conveyer belt 17. Thereafter, the sheet P is conveyed by the conveyer belt 17 from the front side toward the rear side. The toner image carried on the photosensitive drums 11 are transferred onto the sheet P when the sheet P passes through positions between the photosensitive drums 11 and the transfer rollers 18 sequentially.

Thereafter, heat and pressure are applied to the sheet P by the heat roller 19 and the pressure roller 20 when the sheet P passes through a position between the heat roller 19 and the pressure roller 20. In this regard, the toner images on the sheet P are thermally fixed thereon. The sheet P is thereafter ejected from the main body 2 and placed on the ejection tray 8.

2. Detailed Configuration of the Drum Unit

Figure 2:
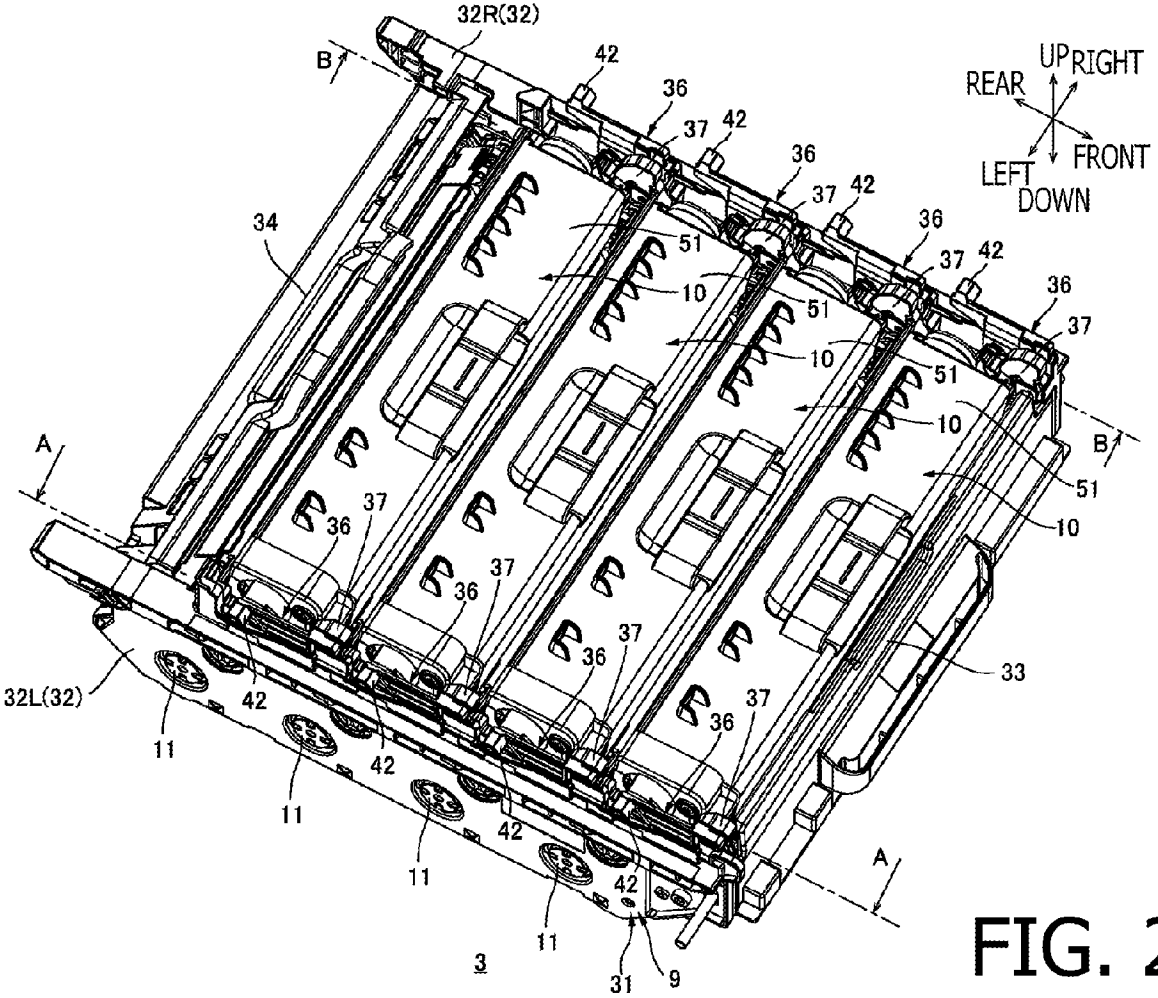
FIG. 2 is a perspective view of a processing unit in the printer according to the first embodiment of the present invention viewed at an upper-left angle.

The drum unit 9 includes, as shown in FIG. 2, a drum frame 31 to support the plurality of photosensitive drums 11 and the plurality of scorotron chargers 12.

The drum frame 31 is an approximately rectangular-shaped frame and includes a pair of lateral plates 32, a front plate 33, and a rear plate 34.

Figure 3B:
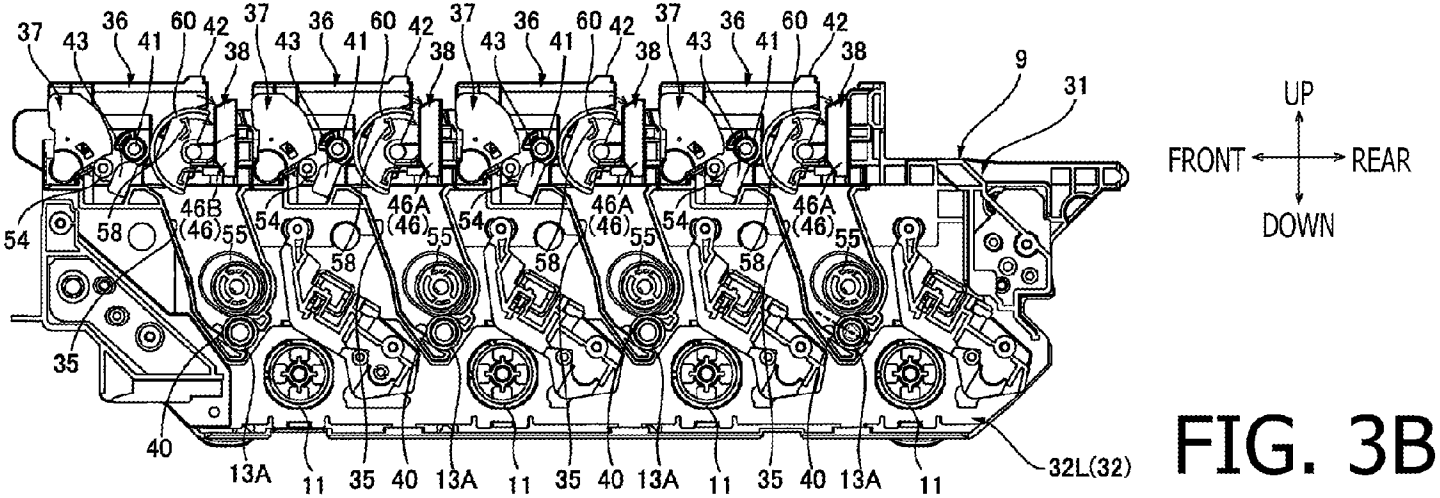
FIG. 3B is a cross-sectional view of the processing unit according to the first embodiment of the present invention taken along a line A-A shown in FIG. 2.
Figure 4:
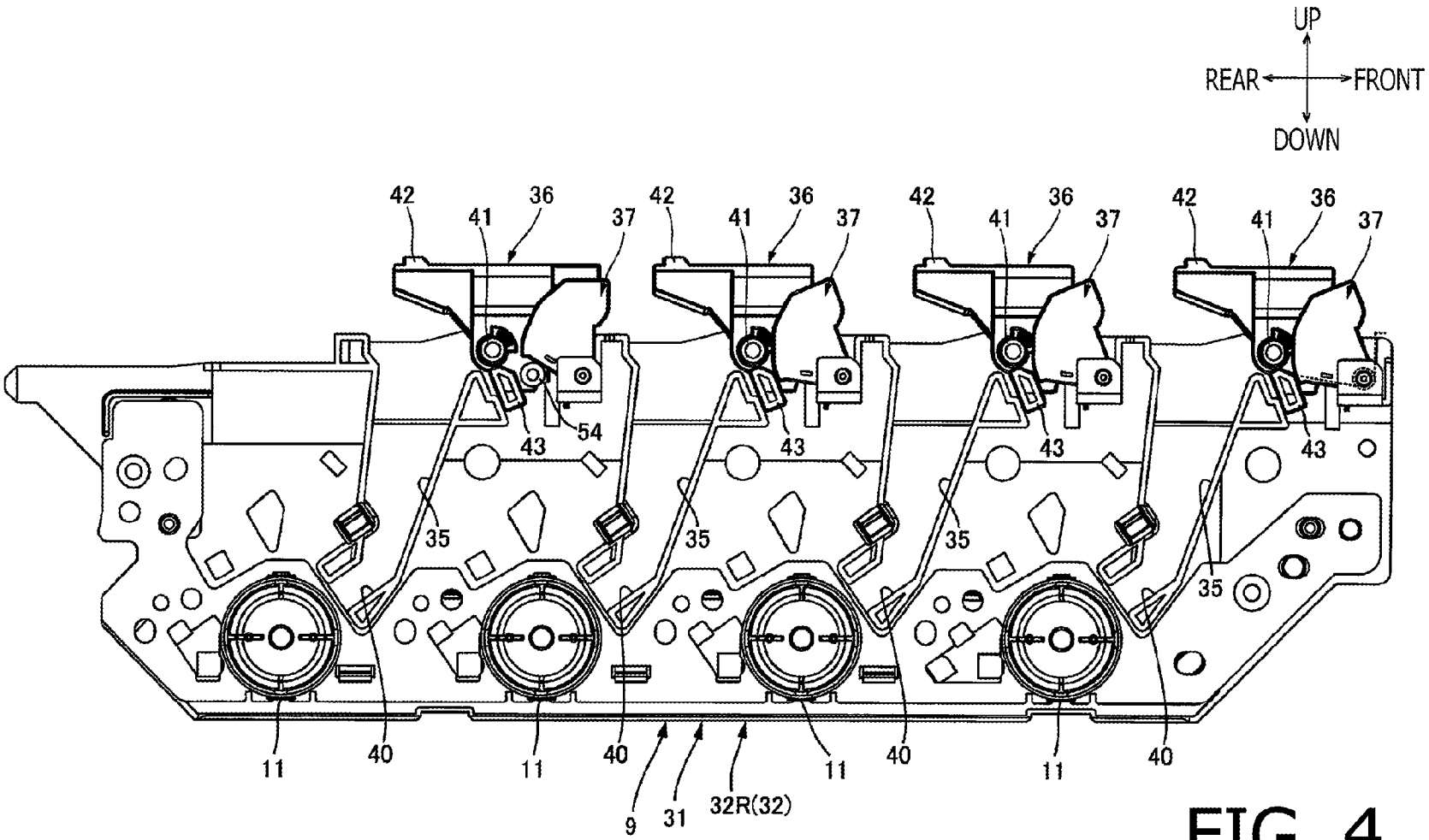
FIG. 4 is a cross-sectional view of the processing unit in the printer according to the first embodiment of the present invention taken along a line B-B shown in FIG. 2.

The paired lateral plates 32 are arranged on crosswise ends of the drum frame 31 to be spaced apart from each other along the crosswise direction. Each of the paired lateral plates 32 is formed to have an approximate shape of a flat rectangle elongated to be longer in the front-rear direction. As shown in FIGS. 3B and 4, each lateral plate 32 includes a plurality of guide grooves 35, a plurality of contact/separation members 36, and a plurality of pressing members 37. A lateral plate 32L, which is one of the lateral plates 32 on the left, includes a plurality of receptacles 39 and a plurality of on-processing unit actuators 38.

The guide grooves 35 are formed on inner sides of the lateral plates 32 in four positions corresponding to the photosensitive drums 11 along the crosswise direction to be evenly spaced apart from one another. Each of the guide grooves 35 is elongated along the vertical direction and has an approximate shape of a top-open "U." Each guide groove 35 is formed to have a positioning groove 40.

The positioning groove 40 is formed at a lower end of each guide groove 35. The positioning groove 40 is formed linearly along a line which extends through an upper-front side and a lower-rear side. A width of the positioning groove 40 along the front-rear direction is substantially equal to an outer diameter of a rotation shaft 13A of the developer roller 13, which will be described later in detail.

Each of the contact/separation members 36 is arranged at an upper end of each lateral plate 32 in an upper-frontward position with respect to each guide groove 35. The contact/separation member 36 is a flat plate formed to have an approximately triangular shape, in a side view when viewed laterally along the crosswise direction. The contact/separation member 36 is rotatable between a first position (see FIG. 4), in which an upper edge of the contact/separation member 36 substantially aligns along the front-rear direction, and a second position (see FIG. 10), in which a front end of the contact/separation member 36 is lowered than a position thereof when the contact/separation member 36 is in the first position. The contact/separation member 36 is urged by an urging force, which is for example applied by a resilient member, in a normal state and tends to be in the first position. The contact/separation member 36 includes a rotation shaft 41, a cam-contact portion 42, and a boss-contact portion 43.

The rotation shaft 41 is arranged at an approximately vertical center of the contact/separation member 36. The rotation shaft 41 is formed to have a round rod, which axially aligns along the crosswise direction. The rotation shaft 41 is rotatably supported by upper ends of the lateral plates 32.

The cam-contact portion 42 is formed at the front end of the contact/separation member 36 in an upper-rear position with respect to the rotation shaft 41. The cam-contact portion 42 is formed to protrude from an outer surface of the contact/separation member 36 further outwardly along the crosswise direction. The cam-contact portion 42 is formed to stretch along the front-rear direction and is bent at a rear end thereof lower-frontward.

The boss-contact portion 43 is formed at a lower position with respect to the rotation shaft 41. The boss-contact portion 43 is formed to protrude from an inner surface of the contact/separation member 36 further inwardly and is formed to have an approximate shape of a rectangular column.

Each of the pressing members 37 is arranged in a frontward position with respect to the boss-contact portion 43 of each contact/separation member 36. The pressing member 37 is formed to have an approximate shape of a sector in a side view when viewed laterally along the crosswise direction. The pressing member 37 is rotatable about a sectorial center thereof and is urged by an urging force in a clockwise direction, when viewed laterally from the right-hand side, in a normal state.

Each of the receptacles 39 is, as shown in FIGS. 3A and 5A, arranged in an upper position in the lateral plate 32L on the left and in a lower-rearward position with respect to each contact/separation member 36. The receptacle 39 is an opening penetrating the lateral plate 32L on the left along the crosswise direction and is formed to have an approximately rectangular shape elongated along the front-rear direction, when viewed laterally along the crosswise direction.

The on-processing unit actuators 38 is arranged in each receptacle 39. The on-processing unit actuator 38 is formed to have an approximate shape of a claw, which is elongated along the crosswise direction and a left end thereof is curved rearward, in a plane view. Each on-processing unit actuator 38 is rotatable between an undetectable position (see FIG. 5A), in which a detectable portion 47 is accommodated in the receptacle 39, and a detectable position, in which the detectable portion 47 at least partly protrudes leftward from the receptacle 39. The on-processing unit actuator 38 is, in a normal state, urged by an urging force toward the undetectable position. The on-processing unit actuator 38 includes a rotation shaft 45, a contact portion 46, and the detectable portion 47.

The rotation shaft 45 is arranged at a front end of the on-processing unit actuator 38. The rotation shaft 45 is formed to have an approximate shape of a round rod extending vertically and is rotatably supported in the receptacle 39.

The contact portion 46 is, as shown in FIG. 3B, arranged in a rearward position with respect to the corresponding contact/separation member 36 and in a rightward position with respect to the rotation shaft 45 to protrude rightward from the receptacle 39. Among the plurality of contact portions 46, contact portions 46A in the on-processing unit actuators 38 corresponding to the colors of yellow, magenta, and cyan are formed to have a longer prism shape elongated vertically so that the contact portions 46A should be contacted by the corresponding contact/separation members 36 when the of the contact/separation members 36 are in the second position. Meanwhile, a contact portion 46B in the on-processing unit actuator 38 corresponding to the color of black is also formed to have the longer prism shape, similarly to the contact portions 46A in the in-processor actuators 38 corresponding to the colors of yellow, magenta, and cyan, elongated vertically so that the contact portion 46B should be contacted by the corresponding contact/separation member 36 when the contact/separation member 36 is in the second position.

In this regard, the contact portions 46 in the on-processing unit actuator 38 corresponding to the colors of black, yellow, magenta, and cyan are formed in association with specification of the photosensitive drums 11 corresponding to the colors of black, yellow, magenta, and cyan respectively.

The specification of the photosensitive drums 11 may include, for example, a charging characteristic of the photosensitive drums 11. For example, the photosensitive drums 11 may include photosensitive drums 11 of a first type and photosensitive drums 11 of a second type. The first-typed photosensitive drums 11 may have a first-typed charging characteristic, by which, when the photosensitive drums 11 should be charged to +800V of a surface potential, a first level of charging bias being +800V is required to be applied to the scorotron chargers 12. Meanwhile, the second-typed photosensitive drums 11 may have a second-typed charging characteristic, by which, when the photosensitive drum 11 should be charged to +800V of the surface potential, a second level of charging bias being higher than the first level and being +820V is required to be applied to the scorotron chargers 12.

If the drum unit 9 is equipped with the first-typed photosensitive drums 11, the contact portion 46B in the on-processing unit actuator 38 corresponding to the color of black is formed to have the longer prism shape, as mentioned above and similarly to the contact portions 46A in the in-processor actuators 38 corresponding to the colors of yellow, magenta, and cyan, elongated vertically so that the contact portion 46B should be contacted by the corresponding contact/separation member 36 when the contact/separation member 36 is in the second position.

Meanwhile, if the drum unit 9 is equipped with the second-typed photosensitive drum 11, the contact portion 46B in the on-processing unit actuator 38 corresponding to the color of black is formed to have a vertically shorter prism shape, as indicated by a vertical line shown in FIG. 3B, so that the contact portion 46B should not be contacted by the corresponding contact/separation member 36 when the contact/separation member 36 is in the second position. On the other hand, the contact portions 46A in the on-processing unit actuators 38 corresponding to the colors of yellow, magenta, and cyan are formed to have the longer prism shape elongated vertically.

The detectable portion 47 is, as shown in FIG. 5A, arranged on a left side of the rotation shaft 45. The detectable portion 47 is formed to have a claw extending from the rotation shaft 45 and curved left-rearward.

The front plate 33 of the drum frame 31 is, as shown in FIG. 2, arranged at a front end of the drum frame 31. The front plate 33 is a flat plate formed to have an approximately rectangular shape, in a front view, elongated along the crosswise direction. The front plate 33 is arranged to bridge a gap between the front ends of the paired lateral plates 32.

The rear plate 34 of the drum frame 31 is arranged at a rear end of the drum frame 31. The rear plate 34 is a flat plate formed to have an approximately rectangular shape, in a front view, elongated along the crosswise direction. The rear plate 34 is arranged to bridge a gap between the rear ends of the paired lateral plates 32.

3. Details of the Developer Cartridge

3.1 Configuration of the Developer Cartridge

Each developer cartridge 10 includes, as shown in FIG. 6, a developer frame 51, which supports the developer roller 13 and the supplier roller 14, and a driving unit 52.

The developer frame 51 is formed to have an approximate shape of a box elongated along the crosswise direction. The developer frame 51 includes an opening 53 and a pair of bosses 54.

The opening 53 is formed at a lower end of the developer frame 51. The opening 53 penetrates a rear wall of the developer frame 51 along the front-rear direction. The opening 53 is formed to have an approximately rectangular shape elongated along the crosswise direction in a rear view along the front-rear direction.

The paired bosses 54 are arranged on upper-front ends of lateral walls of the developer frame 51. Each of the bosses 54 is formed to have an approximate shape of a round rod, which protrudes outwardly from the lateral wall of the developer frame 51 along the crosswise direction.

The driving unit 52 is arranged on a left side of the developer frame 51. The driving unit 52 includes a developer coupling 55, a detection gear 56, and a gear cover 57.

The developer coupling 55 is arranged at a lower end of the driving unit 52. The developer coupling 55 is rotatably supported at a lower end of the lateral wall of the developer frame 51 on the left. The developer coupling 55 is formed to have an approximate shape of a round rod, which extends along the crosswise direction.

The detection gear 56 is arranged at an upper end of the driving unit 52. The detection gear 56 is rotatably supported at a lower end of the lateral wall of the developer frame 51 on the left. The detection gear 56 is a tooth-chipped gear having a toothed portion and a tooth-lacking portion. The detection gear 56 includes a contacting projection 58.

The contacting projection 58 is formed project leftward from a left-side face of the detection gear 56 and has an approximate shape of a flat piece stretching along a radial direction of the detection gear 56. However, a quantity and a shape of the contacting projections 58 depend on, for example, a condition (e.g., newness) of the developer cartridge 10, and information concerning the specification of the developer cartridge 10 (e.g., an amount of printable sheets). In other words, the quantity and the shape of the contacting projections 58 may be used to detect information concerning the condition and the specification of the developer cartridges 10.

The gear cover 57 includes a coupling housing 59 and a detection gear housing 60.

The coupling housing 59 is arranged at a lower end of the gear cover 57. The coupling housing 59 is formed to have an approximate shape of a round rod, which extends leftward from a left-side face of the gear cover 57 to encircle the developer coupling 55.

The detection gear housing 60 is arranged at a lower end of the gear cover 57. The detection gear housing 60 is formed to have an approximately semi-cylindrical shape, which extends leftward from the left-side face of the gear cover 57, and which is closed at a left-side end thereof and is open at a rear end thereof.

The developer roller 13 is arranged at a lower end of the developer frame 51 longitudinally along the crosswise direction in a position such that a rear end portion thereof is exposed through the opening 53. The rotation shaft 13A of the developer roller 13 is rotatably supported at longitudinal and crosswise ends thereof by the lateral walls of the developer frame 51. The crosswise ends of the rotation shaft 13A of the developer roller 13 protrude outwardly from the lateral walls of the developer frame 51 along the crosswise direction.

3.2 Attachment and Detachment of the Developer Cartridge with the Drum Unit

Each of the developer cartridges 10 is, as shown in FIG. 2, attachable to and detachable from the drum unit 9 when the processing unit 3 is at the outer position.

When a user attaches the developer cartridge 10 to the drum unit 9, firstly, the user places a lower end of the developer cartridge 10 in a predetermined position with respect to the drum unit 9.

With the lower end of the developer cartridge 10 in the predetermined position, as shown in FIG. 3B, the crosswise ends of the rotation shaft 13A of the developer roller 13 are guided by the guide grooves 35 in the drum unit 9 to be fitted in the positioning grooves 40. Thereby, the developer roller 13 is placed in an upper-frontward position of the photosensitive drum 11 to face the photosensitive drum 11. In this regard, the bosses 54 of the developer cartridge 10 are arranged in rearward positions with respect to the pressing members 37.

Secondly, the user rotates the developer cartridge 10 frontward about the rotation shaft 13A of the developer roller 13.

In this regard, the bosses 54 press the pressing members 37 against the urging force from the pressing members 37 and proceed downwardly with respect to rear ends of the pressing members 37.

The pressing members 37 are then engaged with the bosses 54 at the rear ends thereof from above and press the developer cartridge 10 lower-rearward. Accordingly, the developer roller 13 is urged against the upper-front portion of the photosensitive drum 11.

Thus, the developer cartridge 10 is attached to the drum unit 9.

The developer cartridge 10 is detachable from the drum unit 9 when the user reverses the procedure described above.

In other words, when the user detaches the developer cartridge 10 from the drum unit 9, firstly, the user rotates the developer cartridge 10 about the rotation shaft 13A of the developer roller 13 rearward and disengages the bosses 54 from the pressing members 37. Secondly, the user draws the developer cartridge 10 upward to remove from the drum unit 9.

4. Configuration of the Main Casing

The main casing 2 includes, as shown in FIGS. 5A, 5B, and 7, sensor units 71, a CPU 72 being a control device, linear motion cams 73, and a pinion gear 83.

The sensor units 71 are arranged in line along the front-rear direction in positions corresponding to the on-processing unit actuators 38. Each of the sensor units 71 includes a photo sensor 74 being an optical sensor and an on-body actuator 75.

The photo sensor 74 includes an emitter element and a receiver element, which are arranged to be spaced apart from each other vertically and face each other. The emitter element emits detectable light toward the receiver element at all time, and the receiver element receives the detectable light from the emitter element. When the receiver element receives the detectable light, the photo sensor 74 generates a light-receiving signal. Meanwhile, when the receiver element does not receive the detectable light, the photo sensor 74 does not generate the light-receiving signal.

The on-body actuator 75 is formed to have an approximate shape of a rod elongated along the front-rear direction. The on-body actuator 75 is rotatable between a blocking position (see FIG. 5A), in which a blocking portion 75 blocks the detectable light in the photo sensor 74, and a non-blocking position (see FIG. 5B), in which the blocking portion 78 does not block the detectable light in the photo sensor 74. The on-body actuator 75 includes a rotation shaft 76, a contact portion 77, and the blocking portion 78.

The rotation shaft 76 is arranged in an approximately lengthwise midst position along the front-rear direction. The rotation shaft 76 is formed to have an approximate shape of a round rod extending axially along the vertical direction.

The contact portion 77 is arranged at a rear end of the on-body actuator 75. The contact portion 77 is formed to have an approximate shape of a prism protruding rightward from a right-hand side of a rear end portion of the on-body actuator 75.

The blocking portion 78 is arranged at a front end of the on-body actuator 75. The blocking portion 78 is formed to have an approximate shape of a flat plate protruding leftward from a left side of a front end portion of the on-body actuator 75.

The CPU 72 is electrically connected with the photo sensors 74 and monitors the light-receiving signals from the photo sensors 74 at a predetermined interval of time.

The linear motion cams 73 are, as shown in FIGS. 7 and 8, arranged on outer sides of the contact/separation members 36, one on each side along the crosswise direction, to face the cam-contact portions 42 of the contact/separation members 36 along the crosswise direction. The linear motion cams 73 are slidable along the front-rear direction. The linear motion cams 73 on the right and the left are in a same configuration;

therefore, in the following description, one on the right will represent the linear motion cams 73, and description of the other one on the left will be omitted. The linear motion cam 73 is integrally formed to have a main part 79 and a plurality of cam portions 80.

The main part 79 is formed to have an approximately rectangular shape, in a side view, elongated along the front-rear direction. The main part 79 includes a rack gear 81.

The rack gear 81 is arranged at a rear end of the main part 79. The rack gear 81 is elongated along the front-rear direction and is formed to have gear teeth on an upper edge thereof.

The plurality of cam portions 80 are arranged in line along the front-rear direction to be spaced apart from one another in positions corresponding to the contact/separation members 36 on an inner side of the main part 79 with regard to the crosswise direction. More specifically, among the plurality of cam portions 80, the cam portions 80 at rearward positions other than the cam portion 80 at the front are arranged to be spaced apart from adjoining cam portions 80 at an equal interval. Meanwhile, the cam portion 80 at the front is spaced apart from the adjoining cam portion 80, which is therefore the second one from the front, for a larger amount than the interval between the cam portions 80 at the rearward positions. Each of the plurality of cam portions 80 is arranged to protrude inwardly from the inner side of the main part 79 with regard to the crosswise direction. Each of the plurality of cam portions 80 is formed to have an approximately rectangular shape, in a side view, elongated along the front-rear direction and is formed to have an inclined face 82.

Each inclined face 82 is arranged at a rear end of each cam portion 80. The inclined face 82 inclines to be higher at the front and lower at the rear.

The pinion gear 83 is arranged to be meshed with the rack gear 81 of the linear motion cam 73 within the main casing 2.

5. Switching Operation Modes of the Printer

Switching of operation modes of the printer 1 will be described hereinbelow with reference to FIGS. 7, 9, and 10.

The printer 1 is operable in one of switchable modes: a color mode, a monochrome mode, and an all-separated mode. In the color mode, an image in colors can be formed, and in the monochrome mode, an image in black can be formed. In the all-separated mode, no image is formed.

5.1 Color Mode

In the color mode, as shown in FIG. 7, the linear motion cam 73 is placed to a color-mode position, in which the rack gear 81 meshes with the pinion gear 83 at the rear end portion thereof.

When the linear motion cam 73 is in the color-mode position, all of the cam portions 80 are placed in frontward spaced-apart positions with respect to the cam-contact portions 42 of the contact/separation members 36 respectively.

In this regard, all the contact/separation members 36 are, as shown in FIGS. 3B and 7, placed in the first position. The boss-contact portion 43 in each contact/separation member 36 is placed in a lower-rear position with respect to the boss 54 in the corresponding developer cartridge 10 to face with the boss 54.

Meanwhile, each of the developer rollers 13 is in a contact position, in which the developer roller 13 is in contact with the corresponding photosensitive drum 11.

Further, each of the contact/separation members 36 on the left-hand side is placed in the frontward spaced-apart position with respect to the corresponding on-processing unit actuator 38.

In other words, as shown in FIG. 5A, all the on-processing unit actuators 38 are placed in the undetectable position. In this regard, the state, in which the contact/separation members 36 are in the first position and the on-processing unit actuators 38 are in the undetectable position, will be referred to as a first state.

Meanwhile, in the first state, all the on-processing unit actuators 38 are placed in the blocking position. In other words, the developer rollers 13 are placed in the contact position when the corresponding contact/separation members 36 and the on-processing unit actuators 38 are in the first state respectively, and none of the photo sensors 74 generates the light-receiving signal.

Therefore, the CPU 72, which receives no light-receiving signal from the photo sensors 74, determines that all the developer rollers 13 are in the contact position.

5.2 Monochrome Mode

When the operation mode in the printer 1 is shifted to the monochrome mode from the color mode, the main casing 2 is manipulated to rotate the pinion gear 83 so that the linear motion cam 73 is moved rearward (see FIGS. 7 and 9).

As the linear motion cam 73 is moved rearward, as shown in FIG. 9, the linear motion cam 73 is placed in a monochrome position, in which the linear motion cam 73 meshes with the pinion gear 83 at an approximate center of the rack gear 81 along the front-rear direction.

In this regard, the three of the cam portions 80 at the rearward positions are placed to contact the cam-contact portions 42 of the corresponding separation members 36 respectively. Meanwhile, the cam portion 80 at the front is placed in a frontward spaced-apart position with respect to the cam-contact portion 42 of the corresponding contact/separation member 36.

Thereby, the contact/separation members 36 corresponding to the developer cartridges 10 for the colors of yellow, magenta, and cyan are rotated from the first position to the second position, while the contact/separation member 36 corresponding to the developer cartridge 10 for the color of black is maintained in the first position.

Accordingly, the boss-contact portions 43 of the contact/separation members 36 corresponding to the colors of yellow, magenta, and cyan press the bosses 54 in the corresponding developer cartridges 10 upper-frontward respectively so that the developer cartridges 10 for the colors of yellow, magenta, and cyan are lifted upper-frontward.

In this regard, with the rotation shafts 13A of the developer rollers 13 in the developer cartridges 10 for the colors of yellow, magenta, and cyan being guided in the positioning grooves 40, the developer rollers 13 are separated upper-frontward from the photosensitive drums 11. In other words, the developer rollers 13 in the developer cartridges 10 for the colors of yellow, magenta, and cyan are placed in separated positions.

Meanwhile, the rear ends of the contact/separation members 36 corresponding to the colors of yellow, magenta, and cyan are placed to contact the contact portions 46 of the corresponding on-processing unit actuators 38 (see FIG. 3B) and press the contact portions 46 rearward.

Accordingly, the on-processing unit actuators 38 corresponding to the developer cartridges 10 for the colors of yellow, magenta, and cyan are rotated about the rotation shafts 45 from the undetectable position to the detectable position, as shown in FIG. 5B.

In this regard, a movable amount D2 between the undetectable position and the detectable position of the on-processing unit actuator 38 is greater than a movable amount D1 (see FIG. 9) between the first position and the second position of the contact/separation member 36. The state, in which the contact/separation members 36 are in the second position and the on-processor actuators 38 are in the detectable position, will be referred to as a second state. Therefore, the developer rollers 13 are placed in the separated position when the corresponding contact/separation members 36 and the on-processing unit actuators 38 are in the second state respectively.

Meanwhile, the detectable portions 47 in the on-processing unit actuators 38 corresponding to the colors of yellow, magenta, and cyan in the second state protrude leftward from the receptacles 39 in the drum frame 31 and press the contact portions 77 in the corresponding on-body actuators 75 leftward.

Thereby, the on-body actuators 75 corresponding to the colors of yellow, magenta, and cyan are rotated about the rotation shafts 76 from the blocking position to the non-blocking position. Accordingly, the photo sensors 74 corresponding to the colors of yellow, magenta, and cyan generate the light-receiving signals.

Therefore, the CPU 72, which receives the light-receiving signals from the photo sensors 74, determines that the developer rollers 13 in the developer cartridges 10 corresponding to the colors of yellow, magenta, and cyan are in the separated position, while the developer roller 13 in the developer cartridge 10 corresponding to the color of black is maintained to be in contact with the photosensitive drum 11.

5.3 All-Separated Mode

When the operation mode in the printer 1 is shifted to the all-separated mode from the monochrome mode, the main casing 2 is manipulated to rotate the pinion gear 83 so that the linear motion cam 73 is moved further rearward.

As the linear motion cam 73 is moved rearward, as shown in FIG. 10, the linear motion cam 73 is placed in an all-separated position, in which the linear motion cam 73 meshes with the pinion gear 83 at a front end of the rack gear 81 along the front-rear direction In this regard, all of the cam portions 80 are placed to contact the cam-contact portions 42 of the corresponding separation members 36 respectively.

Thereby, all of the contact/separation members 36 are rotated about the rotation shafts 41 from the first position to the second position.

Accordingly, all of the boss-contact portions 43 of the contact/separation members 36 press the bosses 54 in the corresponding developer cartridges 10 upper-frontward respectively so that the developer cartridges 10 for the colors of black, yellow, magenta, and cyan are lifted upper-frontward to be placed in the separated position. In other words, while all the contact/separation members 36 and the on-processing unit actuators 38 are in the second state respectively, all the developer rollers 13 are placed in the separated position.

In this regard, if the drum unit 9 is equipped with the photosensitive drums 11 having the first-typed charging characteristic, the rear ends of all the contact/separation members 36 press the corresponding on-processing unit actuator 38 rearward (see FIG. 3B).

Accordingly, all of the on-processing unit actuators 38 corresponding to the developer cartridges 10 for the colors of black, yellow, magenta, and cyan are placed in the detectable position, as shown in FIG. 5B, and press the contact portions 77 in the corresponding on-body actuators 75 leftward.

Thereby, all of the on-body actuators 75 corresponding to the colors of black, yellow, magenta, and cyan are placed in the non-blocking position. Accordingly, all of the photo sensors 74 corresponding to the colors of black, yellow, magenta, and cyan generate the light-receiving signals.

Therefore, the CPU 72, which receives the light-receiving signals from all of the photo sensors 74, determines that all of the developer rollers 13 in the developer cartridges 10 corresponding to the colors of black, yellow, magenta, and cyan are in the separated position.

In the meantime, if the drum unit 9 is equipped with the photosensitive drums 11 having the second-typed charging characteristic, the contact/separation member 36 corresponding to the color of black does not contact the corresponding on-processing unit actuator 38. Therefore, the CPU 72, similarly to the monochrome mode described above, determines that the developer rollers 13 in the developer cartridges 10 corresponding to the colors of yellow, magenta, and cyan are in the separated position, while the developer roller 13 in the developer cartridge 10 corresponding to the color of black is in contact with the photosensitive drum 11.

6. Detecting Newness and Specification of the Developer Cartridges

A flow of behaviors of the printer 1 when unused new developer cartridges 10 are attached to the drum unit 9 will be described with reference to FIGS. 11-12. The flow will be conducted under control of the CPU 72.

As shown in FIG. 11, when the printer 1 detects the front cover 22 being moved from the open position to the closed position (S1: YES), the printer 1 starts a warm-up process.

That is, in S2, the main casing 2 is manipulated to rotate the pinion gear 83 to move the linear motion cam 73 to the color-mode position (S2, FIG. 11. See also FIG. 7).

Accordingly, all of the developer rollers 13 are placed to contact the corresponding photosensitive drums 11, and the CPU 72 determines that all of the developer rollers 13 are in the contact position.

Further, the main casing 2 is manipulated 2 to apply the driving forces to all of the developer couplings 55.

The driving forces applied to the developer couplings 55 are transmitted to the detection gears 56 through gear trains, which are not shown, in the driving units 52. The detection gears 56 are rotated in the clockwise direction, when viewed laterally from the right-hand side (see FIG. 3B).

Along with the rotation of the detection gears 56, the contact projections 58 are rotated in the clockwise direction, when viewed laterally from the right-hand side, to press the contact portions 46 in the on-process actuators 38.

Thereby, the on-processor actuators 38 are rotated about the rotation shafts 45 from the undetectable position to the detectable position (see FIG. 5B).

Meanwhile, the detectable portions 47 in the on-processor actuators 38 press the contact portions 77 in the on-body actuators 75 leftward, and the on-body actuators 75 are rotated about the rotation shafts 76 to move from the blocking position to the non-blocking position. Thus, the photo sensors 74 generate the light-receiving signals.

When the CPU 72 receives the light-receiving signals, within a predetermined time (S5: NO, see FIG. 12) since the start of the warm-up process, the CPU 72 determines in S3 that the developer cartridges 10 are new (S3, see FIG. 11).

When the detection gears 56 are rotated further, the contacting projections 58 are separated downwardly from the contact portions 46.

Accordingly, the on-processing unit actuators 38 are placed in the undetectable position (see FIG. 5A). In the meantime, the on-body actuators 75 are placed in the blocking position. Therefore, the photo sensors 74 stop generating the light-receiving signals.

In this regard, a quantity of the contacting projections 58 correspond to a printable quantity of the sheets P for the developer cartridge 10. For example, one (1) contacting projection 58 indicates that the developer cartridge 10 is capable of printing 3,000 sheets, while two (2) contacting projections 58 indicates that the developer cartridge 10 is capable of printing 6,000 sheets, and so on.

Therefore, if the CPU 72 receives the light-receiving signal once within the predetermined period for the developer cartridge 10 (S5: NO, see FIG. 12) since the warm-up process started, the CPU 72 determines that the developer cartridge 10 is capable of printing 3,000 sheets. Meanwhile, if the CPU 72 receives the light-receiving signal twice within the predetermined period (S5: NO, see FIG. 12) since the warm-up process started, the CPU 72 determines that the developer cartridge 10 is capable of printing 6,000 sheets (see S4, FIG. 11).

Thereafter, the detection gears 56 are rotated for a predetermined amount and stop rotating when the tooth-lacking portions thereof come to face the gear trains (not shown) in the driving units 52.

Meanwhile, if the CPU 72 receives no light-receiving signal within the predetermined period (55: NO, see FIG. 12) since the warm-up process started, the CPU 72 determines that the developer cartridges 10 is not new, but is either having been used or exhausted.

7. Detecting Specification of the Drum Unit

Next, after determining newness of the developer cartridges 10 (S3), and after the predetermined period (S5: YES) since the warm-up process started, the printer 1 starts detecting specification of the drum unit 9, as shown in FIG. 12.

That is, after the predetermined period (S5: YES) since the warm-up process started, the main casing 2 is manipulated to rotate the pinion gear 83 to move the linear motion cam 73 to the all-separated position (S6, FIG. 12. See also FIG. 10).

In this regard, if the drum unit 9 is equipped with the photosensitive drums 11 having the first-typed charging characteristic, as shown in FIG. 5B, all the on-processing unit actuators 38 are in the detectable position, while all the on-body actuators 75 are in the non-blocking position. Accordingly, all the photo sensors 74 generate the light-receiving signal.

The CPU 72 thus receives the light-receiving signal from all the photo sensors 74 (S7: YES, FIG. 12) after the predetermined period since the warm-up process started and determines that the drum unit 9 is equipped with the photosensitive drums 11 having the first-typed charging characteristic (S8, FIG. 12).

Therefore, the CPU 72 sets the charging bias to be applied to the scorotron chargers 12 in the image forming operation to the first-typed charging bias, which is +800V (S9, FIG. 12).

Meanwhile, if the drum unit 9 is equipped with the photosensitive drums 11 having the second-typed charging characteristic, the on-body actuators 75 corresponding to the colors of yellow, magenta, and cyan are in the non-blocking position while the on-body actuator 75 corresponding to the color of black is in the blocking position. Therefore, the photo sensors 74 corresponding to the colors of yellow, magenta, and cyan generate the light-receiving signal while the photo sensor corresponding to the color of black does not generate the light-receiving signal.

The CPU 72 thus receives the light-receiving signal from the photo sensors 74 corresponding to the colors of yellow, magenta, and cyan but does not receive the light-receiving signal from the photo sensor 74 corresponding to the color of black (S7: NO, see FIG. 12) after the predetermined period since the warm-up process started although the printer 1 is in the all-separated mode. Therefore, the CPU 72 determines that the drum unit 9 is equipped with the photosensitive drums 11 having the second-typed charging characteristic (S10, FIG. 12).

Therefore, the CPU 72 sets the charging bias to be applied to the scorotron chargers 12 in the image forming operation to the second-typed charging bias, which is +820V (S11, see FIG. 12).

Thereafter, the main casing 2 is manipulated to rotate the pinion gear 83 to move the linear motion cam 73 to the color-mode position (S12, FIG. 12). The warm-up process ends thereat.

8. Effects

According to the printer 1 described above, the state of the contact/separation members 36 and the on-processing unit actuators 38 can be detected by the photo sensors 74. In particular, as shown in FIGS. 3B, 5B, and 9, it is recognizable that whether the contact/separation members 36 and the on-processing unit actuators 38 are in the first state, in which the developer rollers 13 are placed in the contact position, or in the second state, in which the developer rollers 13 are placed in the separated position.

Therefore, when the first state of the contact/separation members 36 and the on-processing unit actuators 38 is detected, the CPU 72 determines that the developer rollers 13 are in contact with the photosensitive drums 11. Meanwhile, when the second state of the contact/separation members 36 and the on-processing unit actuators 38 is detected, the CPU 72 determines that the developer rollers 13 are separated from the photosensitive drums 11.

Thus, the printer 1 can detect the developer rollers 13 contacting or being separated from the photosensitive drums 11.

According to the printer 1 described above, the contact/separation members 36 place the on-processing unit actuators 38 in the undetectable position when the developer rollers 13 are placed to contact the photosensitive drums 11, and place the on-processing unit actuators 38 in the detectable position when the developer rollers 13 are separated from the photosensitive drums 11.

Thus, based on the positions of the on-processing unit actuators 38 and the contact/separation members 36, the printer 1 can correctly detect the contact or separation of the developer rollers 13 with the photosensitive drums 11.

According to the printer 1 described above, 46 when the on-processing unit actuators 38 are in the undetectable position, as shown in FIGS. 3B, 5B, and 9, the contact portions 46 are in the positions separated from the contact/separation members 36, and when the on-processing unit actuators 38 are in the detectable position, the contact portions 46 are in the positions to contact the contact/separation members 36.

Thus, the printer 1 can correctly detect the positions of the contact/separation members 36 by the sensor units 71 through the on-processing unit actuators 38.

Accordingly, based on the positions of the on-processing unit actuators 38 and the contact/separation members 36, the printer 1 can correctly detect the contact or separation of the developer rollers 13 with the photosensitive drums 11.

According to the printer 1 described above, the movable amount D2 between the undetectable position and the detectable position of the on-processing unit actuator 38 is greater than the movable amount D1 between the first position and the second position of the contact/separation member 36.

Therefore, the on-processing unit actuators 38 may be effectively moved for the greater amount with respect to the movable amount D1 of the contact/separation members 36.

Accordingly, while the movable amount D1 of the contact/separation members 36 is maintained smaller, the movement of the on-processing unit actuators 38 may be correctly detected by the photo sensors 74 through the on-body actuators 75.

According to the printer 1 described above, as shown in FIG. 5B, the movement of the on-process actuators 38 may be correctly detected by the photo sensors 74.

According to the printer 1 described above, the charging characteristic of the photosensitive drums 11 may be determined based on the configuration to detect the contact or separation of the developer rollers 13 with the photosensitive drums 11, that is, based on the behaviors of the contact/separation members 36, the on-processing unit actuators 38, the on-body actuators 75, and the photo sensors 74.

Accordingly, the charging characteristic of the photosensitive drums 11 may be determined by use of the simplified configuration without preparing a dedicated unit or configuration to determine the charging characteristic of the photosensitive drums 11 specifically.

According to the printer 1 described above, newness of the developer cartridges 10 may be determined by use of the contact/separation members 36, the on-processing unit actuators 38, the on-body actuators 75, and the photo sensors 74.

Accordingly, newness of the developer cartridges 10 may be determined without preparing a dedicated unit or configuration to determine newness of the developer cartridges 10 specifically.

9. Modified Examples

Although an example of carrying out the invention has been described, those skilled in the art will appreciate that there are numerous variations and permutations of the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

According to the previous embodiment, all the on-body actuators 75 are in the non-blocking position when the drum unit 9 is equipped with the photosensitive drums 11 having the first-typed charging characteristic. On the other hand, the on-body actuators 75 corresponding to the colors of yellow, magenta, and cyan are in non-blocking position and the on-body actuator 75 corresponding to the color of black is in the blocking position when the drum unit 9 is equipped with the photosensitive drums 11 having the second-typed charging characteristic. However, the arrangement of the on-body actuators 75 and the blocking/non-blocking position may not necessarily be limited to those described above.

For example, it may be configured to determine that the drum unit 9 is equipped with the photosensitive drums 11 having a third-typed charging characteristic, which is different from the first type and the second type, when the on-body actuators 75 corresponding to the colors of black, yellow, and cyan are in the non-blocking position while the on-body actuator 75 corresponding to the color of magenta is in the blocking position.

For another example, the type of the photosensitive drums 11 corresponding to the colors of black, yellow, magenta, and cyan contained in the drum unit 9 may not necessarily be the same, but different types of the photosensitive drums 11 may be included in the drum unit 9.

In particular, when the on-body actuators 75 corresponding to the colors of black, yellow, and cyan are in the non-blocking position while the on-body actuator 75 corresponding to the color of magenta is in the blocking position, the CPU 72 may determine that the photosensitive drums 11 corresponding to the colors of black, yellow, and cyan have the first-typed charging characteristic, while the photosensitive drum 11 corresponding to the color of magenta have the second-typed charging characteristic.

For another example, the embodiment described above may not necessarily be applied to a color printer but may be employed in, for example, a monochrome printer, a copier, or a multifunction peripheral device.

10. Second Embodiment

A second embodiment of the present invention will be described with reference to FIGS. 13-18. In the second embodiment described below, items or structures which are the same as or similar to the items or the structures described in the previous embodiment will be referred to by the same reference signs, and description of those will be omitted.

10.1 Overall Configuration of the Printer in the Second Embodiment

In the first embodiment described above, the printer 1 is equipped with the drum unit 9 having the photosensitive drums 11, the developer rollers 13, and the developer cartridges 10 detachably attached to the drum unit 9. Meanwhile, the printer 1 in the second embodiment is equipped with processing cartridges 91, each of which is configured to have a drum unit 92 containing the photosensitive drum 11 and developer unit 93 containing the developer roller 13 integrally.

10.2 Configuration of the Processing Cartridge

Each of the processing cartridges 91 is arranged in a position corresponding to one of the colors of black, yellow, magenta, and cyan. Each processing cartridge 91 includes, as shown in FIGS. 13 and 14, a pair of lateral plates 90, the drum unit 92, and the developer unit 93.

The pair of lateral plates 90 are arranged on crosswise ends of the processing cartridge 91, and each of the lateral plates 90 is formed to have an approximately quadrilateral shape in a side view when viewed laterally along the crosswise direction.

The drum unit 92 is arranged at a rear end of the lateral plates 90 to bridge the gap between the paired lateral plates 90. The drum unit 92 is formed to have a shape of a sleeve longitudinally extending along the crosswise direction, of which cross sectional shape is approximately triangular. The drum unit 92 rotatably supports the photosensitive drum 11.

The developer unit 93 is arranged in a frontward position with respect to the drum unit 92. The developer unit 3 is formed to have an approximate shape of a box longitudinally extending along the crosswise direction. The developer unit 93 is arranged in a position between the paired lateral plates 90 and supported swingably by the rear ends of the paired lateral plates 90. The developer unit 93 includes a slider member housing 96, a slider member 94, a pivotable member housing 97, a pivotable member 95, and rotation shafts 100.

The slider member housing 96 is arranged in a rear-leftward position in the developer unit 93. The slider member housing 96 is formed to have an approximately rectangular shape in a plane view recessing downward from an upper surface of the developer unit 93.

The slider member 94 is arranged in the slider member housing 96. The slider member 94 is formed to have an approximate shape of a rod, which longitudinally extends along the front-rear direction. The slider member 94 is slidable along the front-rear direction.

The pivotable member housing 97 is arranged in a frontward position with respect to the slider member housing 96 on a leftward end of the developer unit 93. The pivotable member housing 97 is formed to have an approximately rectangular shape in a plane view recessing downward from the upper surface of the developer unit 93.

The pivotable member 95 is arranged in the pivotable member housing 97. The pivotable member 95 is formed to have an approximate shape of a bar longitudinally extending along the crosswise direction. The pivotable member 95 is pivotable about a rightward end thereof to move between a non-engageable position (see FIG. 13), in which a leftward end thereof is accommodated in the pivotable member housing 97, and an engageable position (see FIG. 15), in which the leftward end thereof protrudes upward from the pivotable member housing 97, and in which the pivotable member 95 is engageable with the linear motion cam 101. A pivot axis of the pivotable member 95 extends along the front-rear direction. The pivotable member 95 includes a cam surface 98 and a blocking plate 99.

The cam surface 98 is formed on a rear side and on a rightward end of the pivotable member 95. The cam surface 98 is formed to incline, when the pivotable member 95 is in the non-engaged position, to be lower at the front and higher at the rear.

The blocking plate 99, as shown in FIG. 15, spreads rearward from a leftward end and a rear face of the pivotable member 95. The blocking plate 99 is formed to have an approximately rectangular shape longitudinally spreading vertically, in a side view when viewed laterally along the crosswise direction.

The rotation shafts 100 are arranged in an approximately vertically central positions on crosswise end surfaces of the developer unit 93. The rotation shafts 100 are formed to have an approximate shape of a round rod extending outwardly along the crosswise direction from the crosswise end surfaces of the developer unit 93. The rotation shafts 100 are rotatably supported by the lateral plates 90 of the drum unit 92.

10.3 Configuration of the Main Casing

The main casing 2 includes a linear motion cam 101 as shown in FIG. 15.

The linear motion cam 101 is arranged in an upper position with respect to a leftward end portion of the processing cartridge 91. The linear motion cam 101 is formed to have a rod elongated along the front-rear direction. The linear motion cam 101 includes a contact portion 102 and a pressing member 103.

The contact portion 102 is arranged in a frontward position with respect to the pivotable member 95 in a corresponding one of the processing cartridges 91. The contact portion 102 is a piece of plate formed to have an approximately rectangular shape in a front view and arranged to protrude rightward from a right-side face of the linear motion cam 101. The contact portion 102 includes a photo sensor 106.

The photo sensor 106 includes an emitter 104 and an receiver 105.

The emitter 104 is arranged at a leftward end of the contact portion 102 to be supported by the contact portion 102. The emitter 104 is formed to have an approximately rectangular shape in a side view when viewed laterally along the crosswise direction. The emitter 104 emits detectable light toward the receiver 105 along the crosswise direction.

The receiver 105 is arranged at a rightward end of the contact portion 102 to be supported by the contact portion 102. The receiver 105 is formed to have an approximately rectangular shape in a side view when viewed laterally along the crosswise direction. The receiver 105 receives the detectable light emitted from the emitter 104.

The pressing member 103 is arranged at a rearward position with respect to the contact portion 102. The pressing member 103 is formed to have an approximate shape of an "L," which is elongated along the front-rear direction and bent downward at a rear end thereof, in a side view when viewed laterally along the crosswise direction.

10.4 Contact/Separation Movement

Upon attachment of the processing cartridges 91 to the main casing 2, the main casing 2 manipulates the liner motion cam 101 and the pressing member 103 to move to a first position, in which a lower end of the pressing member 103 is placed in a rearward position within the slider-member housing 96 (see FIGS. 15 and 16).

With the lower end of the pressing member 103 placed in the rearward position within the slider-member housing 96, the slider member 94 is pressed frontward by the pressing member 103 and presses the pivotable member 95 at the cam surface 98 by a front end thereof.

Accordingly, the pivotable member 95 is pivoted about the rightward end thereof from the non-engageable position to the engageable position with the leftward end thereof uplifted to protrude from the pivotable member housing 97. Thereby, the blocking plate 99 at the leftward end of the pivotable member 95 blocks the detectable light of the photo sensor 106.

Accordingly, the photo sensor 106 stops generating the light-receiving signal.

With no light-receiving signal received from the photo sensor 106, the CPU 72 determines that the pivotable member 95 is in the engageable position.

Thereafter, the main casing 2 is manipulated to move the linear motion cam 101 to a second position (see FIG. 17), which is rearward with respect to the first position.

Accordingly, the contact portion 102 of the linear motion cam 101 contacts the front face of the pivotable member 95 which is in the engageable position and presses the pivotable member 95 rearward.

In this regard, with the pivotable member 95 being pressed rearward, the developer unit 93 rotates about the rotation shafts 100 in the clockwise direction, when viewed laterally from the right-hand side along the crosswise direction.

Accordingly, the developer roller 13 is separated frontward from the photosensitive drum 11.

After determining that the pivotable member 95 is in the engageable position, the CPU 72 manipulates the linear motion cam 101 to move to the second position and determines that the developer roller 13 is separated from the photosensitive drum 11.

Meanwhile, when the pivotable member 95 is in the non-engageable position, with the blocking plate 99 being accommodated in the pivotable member housing 97, the CPU 72 receives the light-receiving signal from the photo sensor 106 and determines that the pivotable member 95 is in the non-engageable position, and therefore the developer roller 13 is in contact the photosensitive drum 11.

10.5 Effects by the Second Embodiment

According to the printer 1 in the second embodiment described above, by being engaged with the pivotable member 95 in the engageable position, as shown in FIG. 17, the linear motion cam 101 may place the developer roller 13 in the separated position. Meanwhile, the linear motion cam 101 is not engageable with the pivotable member 95 in the non-engageable position, as shown in FIGS. 13 and 14; therefore, when the pivotable member 95 is in the non-engageable position, the developer roller 13 is in the contact position.

Therefore, the CPU 72 in the main casing 2 determines that the developer roller 13 is separated from the photosensitive drum 11 when the pivotable member 95 is in the engageable position (see FIG. 15) and after manipulating the linear motion cam 101 to move to the second position (see FIG. 17).

Meanwhile, the CPU 72 in the main casing 2 determines, when the pivotable member 95 in the non-engageable position is detected by the CPU 72 in the main casing 2, that the developer roller 13 is in contact with the photosensitive drum 11.

Thus, based on the positions of the pivotable member 95 and the linear motion cam 101, the printer 1 can correctly detect the contact or separation of the developer rollers 13 with the photosensitive drums 11.

According to the printer 1 in the second embodiment, the detectable light in the photo sensor 106 is emitted from the emitter 104 toward the receiver 105 along the crosswise direction, while the pivotable member 95 is pivotable about the pivot axis extending along the front-rear direction.

Therefore, the pivotable member 95 may be placed to stably interfere with the detectable light so that the movement of the pivotable member 95 may be correctly detected by the photo sensor 106.

10.6 Modified Example of the Second Embodiment

The emitter 104 and the receiver 105 in the photo sensor 106 may not necessarily be arranged along the crosswise direction to be separated apart from each other but may be arranged along the front-rear direction to be separated apart from each other, as shown in FIG. 18.

What is claimed is:

1. An image forming apparatus, comprising:

a main body; and a cartridge configured to be detachably attached to the main body, the cartridge comprising:

a photosensitive member configured to carry an image formed in a developer agent thereon, a movable mechanism, and a developer cartridge comprising a developer roller configured to supply the developer agent to the photosensitive member, wherein the movable mechanism comprises a first movable member and a second movable member, the first movable member being configured to move between a roller contacting position, at which the first movable member causes the developer roller to contact the photosensitive member, and a roller spaced position, at which the first movable member causes the developer roller to be spaced from the photosensitive member, wherein the developer cartridge comprises a driving coupling and a gear, wherein the main body is configured to apply a driving force to the driving coupling, and the driving coupling is configured to transmit the driving force to the gear, wherein the gear comprises a projection configured to contact the second movable member, and the gear is configured to move, in accordance with the driving force, between a projection contacting position, at which the projection contacts the second movable member, and a projection spaced position, at which the projection is spaced from the second movable member, wherein the movable mechanism is configured to shift between a first state and a second state, wherein the main body comprises a detectable member configured to detect a state of the movable mechanism between the first state and the second state, wherein the detectable member is configured to detect the second state when the first movable member is located at the roller separated position irrespective of a position of the gear, wherein the detectable member is configured to also detect the second state when the gear is located at the projection contacting position irrespective of a position of the first movable member, and wherein the detectable member is configured to detect the first state when the first movable member is located at the roller contacting position and the gear is located at the projection separated position.

2. The image forming apparatus according to claim 1, wherein the second movable member is configured to be moved along with the first movable member moving between the roller contacting position and the roller spaced position;

wherein the detectable member detects the state of the movable mechanism based on a position of the second movable member; and wherein the second movable member is movable between an undetectable position, at which the second movable member is undetectable by the detectable member when the first movable member is located at the roller contacting position, and a detectable position, at which the second movable member is detectable by the detectable member when the first movable member is located at the roller spaced position.

3. The image forming apparatus according to claim 2, wherein, when located at the undetectable position, the second movable member is spaced apart from the first movable member; and wherein, when located at the detectable position, the second movable member is in contact with the first movable member.

4. The image forming apparatus according to claim 3, further comprising:

a control device; and a plurality of cartridges including the cartridge, each of the plurality of cartridges having a same configuration as the cartridge, wherein a photosensitive drum of each of the plurality of cartridges has one of a first specification and a second specification, at least one of the plurality of cartridges having a photosensitive drum of the first specification, wherein a second movable member, which corresponds to a cartridge having the photosensitive drum of the first specification, has a first shape, and contacts a corresponding first movable member when the first movable member is located at the roller spaced position, wherein a second movable member, which corresponds to a cartridge having the photosensitive drum of the second specification, has a second shape, and contacts a corresponding first movable member when the first movable member is located at the roller spaced position or the roller contacting position, wherein the control device is configured to determine a specification of each photosensitive drum of the plurality of cartridges based on the state of a corresponding movable mechanism detected by a corresponding detectable member.

5. The image forming apparatus according to claim 2, wherein a movable amount for the second movable member to move between the undetectable position and the detectable position is greater than a movable amount for the first movable member to move between the roller contacting position and the roller spaced position.

6. The image forming apparatus according to claim 1, wherein the detectable member comprises an optical sensor.

7. The image forming apparatus according to claim 1, wherein the second movable member is configured to be engageable with the first movable member, and to be moved along with the first movable member moving between the roller contacting position and the roller spaced position;

wherein the second movable member is movable between a non-engageable position, at which the second movable member is non-engageable with the first movable member when the first movable member is located at the roller contacting position, and an engageable position, at which the second movable member is engageable with the first movable member when the first movable member is located at the roller spaced position; and wherein the detectable member detects the state of the movable mechanism based on detection of the second movable member; and wherein the detectable member detects the second movable member when the second movable member is located at the engageable position, and the detectable member does not detect the second movable member when the second movable member is located at the non-engageable position.

8. The image forming apparatus according to claim 7, wherein the detectable member comprises an optical sensor;

wherein the second movable member is configured to pivot about a pivot axis to move between the non-engageable position and the engageable position; and wherein the pivot axis of the second movable member extends along a direction orthogonal to detectable light emitted in the optical sensor.

9. The image forming apparatus according to claim 1, further comprising:

a cover attached to the main body, the cover being movable between an open position and a closed position; and a control device, wherein the developer cartridge is configured to be detachably attached to the cartridge, wherein, when the cover is moved to the closed position, the control device controls the main body such that the main body outputs the driving force to move the gear, and wherein the control device is configured to determine newness of the developer cartridge based on the state of the movable mechanism detected by the detectable member.

* * * * *